US006024169A

United States Patent [19]

Haugen

[11] Patent Number: 6,024,169

[45] **Date of Patent: *Feb. 15, 2000**

[54] METHOD FOR WINDOW FORMATION IN WELLBORE TUBULARS

[75] Inventor: David M. Haugen, League City, Tex.

[73] Assignee: Weatherford/Lamb, Inc.

[ * ] Notice: This patent is subject to a terminal disclaimer.

[21] Appl. No.: 08/956,702

[22] Filed: Oct. 24, 1997

Related U.S. Application Data

[62] Division of application No. 08/760,283, Dec. 4, 1996, Pat. No. 5,791,417, which is a continuation of application No. 08/688,301, Jul. 30, 1996, Pat. No. 5,709,265, which is a continuation-in-part of application No. 08/568,878, Dec. 11, 1995, Pat. No. 5,636,692.

[51] Int. Cl.[7] ..... E21B 43/116

[52] U.S. Cl. ..... 166/298; 166/55.2

[58] Field of Search ..... 166/55.2, 117.6, 166/123, 297, 298, 382

[56] References Cited

U.S. PATENT DOCUMENTS

| | | | |
|---|---|---|---|
| H1598 | 10/1996 | O'Reilly et al. . | |
| 941,852 | 11/1909 | Broadwater | 102/21 |
| 1,641,483 | 9/1927 | Greene | 102/21 |
| 2,067,408 | 1/1937 | Morris | 166/63 |
| 2,080,875 | 5/1937 | Pitzer | 166/299 |
| 2,141,827 | 12/1938 | Schlumberger | 102/1 |
| 2,169,671 | 8/1939 | Walker | 175/4.55 |
| 2,214,226 | 9/1940 | English . | |
| 2,302,567 | 11/1942 | O'Neill | 166/1 |
| 2,315,496 | 4/1943 | Boynton | 166/1 |
| 2,519,116 | 8/1950 | Crake . | |
| 2,535,964 | 12/1950 | Stanton . | |
| 2,566,682 | 9/1951 | Sweetman . | |
| 2,587,244 | 2/1952 | Sweetman . | |
| 2,621,351 | 12/1952 | Piety | 15/104.05 |
| 2,629,445 | 2/1953 | Dill | 166/55 X |
| 2,679,380 | 5/1954 | Sweetman . | |
| 2,680,487 | 6/1954 | Carpenter | 166/1 |
| 2,703,053 | 3/1955 | Castel | 102/20 |
| 2,719,485 | 10/1955 | Bendar . | |
| 2,758,543 | 8/1956 | Grandin . | |
| 2,760,408 | 8/1956 | Taylor . | |
| 2,858,653 | 11/1958 | Guptill, Jr. | 51/282 |

(List continued on next page.)

FOREIGN PATENT DOCUMENTS

| | | |
|---|---|---|
| 95/302209 | of 1995 | European Pat. Off. . |
| 2745408 | of 1979 | Germany . |

OTHER PUBLICATIONS

"Seminar on Oilfield Explosives," Ensign–Brickford Co., 1995.

"Recommended Practices For Oilfield Explosives Safety," American Petroleum Institute, 1994.

"Perforating Technology For the 21st Century," Hart's Pertoleum Engineer Int'l, Sep. 1996, pp. 61–81.

U.S. Patents Official Gazette entry for U.S. 5,603,379, Feb. 18, 1997.

"Procedures for Running Explosives For Wellhead Severance," A–1 Homco, pp. 1–32, 1993.

Int'l Search Report, Int' Application No. PCT/GB96/03059, filed Nov. 12, 1996.

U.S. Patents Official Gazette entry for U.S. 5,603,379, 18 Feb 97.

"Procedures for Running Explosives For Wellhead Severance." A–1 Homco, pp.1–32, 1993.

*Primary Examiner*—Frank S. Tsay
*Attorney, Agent, or Firm*—Guy McClung

[57] ABSTRACT

New systems and methods have been invented for explosively forming openings, ledges, windows, holes, and lateral bores through tubulars such as casing, which openings may, in cerain aspects, extend beyond the casing into a formation through which a wellbore extends. In certain aspects openings (e.g. ledges, initial, or completed windows) in wellbore tubulars (e.g. tubing or casing) are made using metal oxidizing systems, water jet systems, or mills with abrasive and/or erosive streams flowing therethrough and/or therefrom.

17 Claims, 22 Drawing Sheets

U.S. PATENT DOCUMENTS

| | | | |
|---|---|---|---|
| 2,897,756 | 8/1959 | Borins et al. | 102/21 |
| 2,918,125 | 12/1959 | Sweetman | 166/55 X |
| 3,010,396 | 11/1961 | Coleman | 175/4.55 |
| 3,014,423 | 12/1961 | Robinson, Jr. et al. | 102/20 |
| 3,048,102 | 8/1962 | LeBourg . | |
| 3,053,182 | 9/1962 | Christopher . | |
| 3,066,735 | 12/1962 | Zingg | 166/55 |
| 3,066,736 | 12/1962 | Venghiattis | 166/55.1 |
| 3,070,011 | 12/1962 | Robinson, Jr. et al. . | |
| 3,076,507 | 2/1963 | Sweetman | 166/55 X |
| 3,088,006 | 4/1963 | Kabik et al. . | |
| 3,118,508 | 1/1964 | Friedman et al. . | |
| 3,138,207 | 6/1964 | Peppers | 166/63 |
| 3,175,617 | 3/1965 | North | 166/55.1 |
| 3,273,642 | 9/1966 | Karpovich | 166/299 |
| 3,318,395 | 5/1967 | Messmer | 175/14 |
| 3,327,781 | 6/1967 | Nutter . | |
| 3,404,919 | 10/1968 | Dixon | 299/13 |
| 3,576,219 | 4/1971 | Angona | 175/4.5 |
| 3,654,866 | 4/1972 | Fritz | 102/312 |
| 3,706,340 | 12/1972 | Schuster | 166/297 |
| 3,874,461 | 4/1975 | Cocanower | 175/4.6 |
| 3,878,786 | 4/1975 | Ridgeway | 102/27 R |
| 3,951,218 | 4/1976 | Sjogrén | 175/4.6 |
| 3,965,993 | 6/1976 | LaVigne et al. | 175/4.6 |
| 3,990,507 | 11/1976 | Vann | 166/55.1 |
| 3,990,512 | 11/1976 | Kuris | 166/299 |
| 4,040,482 | 8/1977 | Vann | 166/255 |
| 4,071,096 | 1/1978 | Dines | 175/4.6 |
| 4,078,611 | 3/1978 | Vann | 166/297 |
| 4,106,561 | 8/1978 | Jerome et al. | 166/55.2 |
| 4,113,016 | 9/1978 | Trott | 166/297 |
| 4,119,148 | 10/1978 | Deardorf | 166/250 |
| 4,122,899 | 10/1978 | Brieger | 166/297 |
| 4,132,247 | 1/1979 | Calder, Jr. et al. | 86/20 |
| 4,180,131 | 12/1979 | Chammas | 166/297 |
| 4,208,966 | 6/1980 | Hart | 102/20 |
| 4,352,397 | 10/1982 | Christopher | 166/297 |
| 4,354,433 | 10/1982 | Owen | 102/307 |
| 4,357,873 | 11/1982 | Jager | 102/310 |
| 4,378,844 | 4/1983 | Parrish et al. | 166/297 |
| 4,409,481 | 10/1983 | Huber et al. | 166/297 |
| 4,509,604 | 4/1985 | Upchurch | 175/4.52 |
| 4,511,296 | 4/1985 | Stol | 411/20 |
| 4,538,680 | 9/1985 | Brieger et al. | 166/55 |
| 4,544,034 | 10/1985 | George | 166/297 |
| 4,560,000 | 12/1985 | Upchurch | 166/55.1 |
| 4,566,544 | 1/1986 | Bagley et al. | 175/4.56 |
| 4,598,769 | 7/1986 | Robertson | 166/55 |
| 4,601,498 | 7/1986 | Haugen | 285/332.3 |
| 4,610,312 | 9/1986 | Nelson et al. | 175/4.52 |
| 4,612,985 | 9/1986 | Rubbo et al. | 166/114 |
| 4,614,156 | 9/1986 | Cole, Jr. et al. | 102/312 |
| 4,616,718 | 10/1986 | Gambertoglio | 175/4.54 |
| 4,633,945 | 1/1987 | Upchurch | 166/55.1 |
| 4,637,478 | 1/1987 | George | 175/4.51 |
| 4,655,298 | 4/1987 | George et al. | 175/4.52 |
| 4,662,450 | 5/1987 | Haugen | 166/299 |
| 4,669,540 | 6/1987 | Luoma et al. | 166/135 |
| 4,694,754 | 9/1987 | Dines et al. | 102/310 |
| 4,699,241 | 10/1987 | Kerekes | 181/116 |
| 4,716,963 | 1/1988 | George et al. | 166/123 |
| 4,726,610 | 2/1988 | George et al. | 285/39 |
| 4,744,424 | 5/1988 | Lenderman et al. | 175/4.51 |
| 4,760,884 | 8/1988 | Haugen et al. | 166/377 |
| 4,762,179 | 8/1988 | Wesson et al. | 166/297 |
| 4,787,315 | 11/1988 | Kenny | 102/313 |
| 4,796,709 | 1/1989 | Lynde et al. | 166/55.6 |
| 4,798,244 | 1/1989 | Trost | 166/250 |
| 4,800,958 | 1/1989 | Haugen et al. | 166/55.1 |
| 4,886,126 | 12/1989 | Yates, Jr. | 175/4.54 |
| 4,887,668 | 12/1989 | Lynde et al. | 166/55.8 |
| 4,898,244 | 2/1990 | Schneider et al | 166/297 |
| 4,901,802 | 2/1990 | George et al. | 175/4.52 |
| 4,905,759 | 3/1990 | Wesson et al. | 166/55 |
| 4,909,320 | 3/1990 | Hebert et al. | 166/55.1 |
| 4,911,251 | 3/1990 | George et al. | 175/4.54 |
| 4,924,952 | 5/1990 | Schneider | 175/4.54 |
| 4,938,291 | 7/1990 | Lynde et al. | 166/55.8 |
| 4,969,525 | 11/1990 | George et al. | 166/297 |
| 4,978,260 | 12/1990 | Lynde et al. | 166/55.6 |
| 4,984,488 | 1/1991 | Lunde et al. | 166/55.6 |
| 5,014,778 | 5/1991 | Lynde et al. | 166/55.6 |
| 5,016,716 | 5/1991 | Donovan et al. | 175/17 |
| 5,022,485 | 6/1991 | Mitchell | 181/106 |
| 5,038,859 | 8/1991 | Lynde et al. | 166/55.6 |
| 5,044,437 | 9/1991 | Wittrisch | 166/250 |
| 5,054,555 | 10/1991 | Lalande et al. | 166/298 |
| 5,058,666 | 10/1991 | Lynde et al. | 166/55.6 |
| 5,067,568 | 11/1991 | Yates, Jr. et al. | 175/4.52 |
| 5,086,838 | 2/1992 | Cassel et al. | 166/55.6 |
| 5,101,907 | 4/1992 | Shultz et al. | 166/386 |
| 5,103,906 | 4/1992 | Schultz et al. | 166/264 |
| 5,103,911 | 4/1992 | Heijnen | 166/297 |
| 5,111,885 | 5/1992 | Umphries | 166/297 |
| 5,150,755 | 9/1992 | Cassel et al. | 166/297 |
| 5,161,616 | 11/1992 | Colla | 166/297 |
| 5,167,282 | 12/1992 | Schneider et al. | 166/297 |
| 5,177,321 | 1/1993 | Kenny | 102/312 |
| 5,199,513 | 4/1993 | Stewart et al. | 175/73 |
| 5,215,148 | 6/1993 | Ricles | 166/298 |
| 5,238,070 | 8/1993 | Schultz et al. | 166/386 |
| 5,279,363 | 1/1994 | Schultz et al. | 166/53 |
| 5,289,876 | 3/1994 | Graham | 166/276 |
| 5,297,630 | 3/1994 | Lynde et al. | 166/297 |
| 5,301,755 | 4/1994 | George et al. | 166/297 |
| 5,301,760 | 4/1994 | Graham | 175/61 |
| 5,322,127 | 6/1994 | McNair et al. | 166/313 |
| 5,337,808 | 8/1994 | Graham | 166/191 |
| 5,353,876 | 10/1994 | Curington et al. | 166/313 |
| 5,355,957 | 10/1994 | Burleson et al. | 166/297 |
| 5,370,186 | 12/1994 | Ireland | 166/297 |
| 5,373,900 | 12/1994 | Lynde et al. | 166/297 |
| 5,381,631 | 1/1995 | Raghavan et al. | 451/75 |
| 5,427,177 | 6/1995 | Jordan, Jr. et al. | 166/50 |
| 5,435,394 | 7/1995 | Robertson | 166/382 |
| 5,435,400 | 7/1995 | Smith | 175/61 |
| 5,456,312 | 10/1995 | Lynde et al. | 166/55.6 |
| 5,467,824 | 11/1995 | DeMarsh et al. | 166/297 |
| 5,477,785 | 12/1995 | Dieman et al. | 102/313 |
| 5,477,925 | 12/1995 | Trahan et al. | 166/382 |
| 5,483,895 | 1/1996 | Tomek et al. | 102/312 |
| 5,490,563 | 2/1996 | Wesson et al. | 166/297 |
| 5,495,806 | 3/1996 | Willey . | |
| 5,499,579 | 3/1996 | Lewis . | |
| 5,501,153 | 3/1996 | Cassagne et al. . | |
| 5,501,154 | 3/1996 | Rodney et al. . | |
| 5,503,077 | 4/1996 | Motley | 102/202.5 |
| 5,503,078 | 4/1996 | LeTual | 102/202.13 |
| 5,505,134 | 4/1996 | Brooks et al. . | |
| 5,505,260 | 4/1996 | Andersen et al. | 166/278 |
| 5,505,261 | 4/1996 | Huber et al. | 166/297 |
| 5,506,136 | 4/1996 | Cauchetier et al. . | |
| 5,507,230 | 4/1996 | Lewis et al. . | |
| 5,509,481 | 4/1996 | Huber et al. | 166/297 |
| 5,524,523 | 6/1996 | Lubbe et al. | 86/20.15 |
| 5,531,164 | 7/1996 | Mosley | 102/312 |
| 5,540,293 | 7/1996 | Mohaupt | 175/3.5 |
| 5,542,480 | 8/1996 | Owen et al. | 175/4.15 |
| 5,551,344 | 9/1996 | Couet et al. | 102/312 |
| 5,590,723 | 1/1997 | Walker et al. | 175/4.6 |
| 5,598,894 | 2/1997 | Burleson et al. | 175/4.52 |

5,603,379 2/1997 Henke et al. ..... 166/297
5,613,557 3/1997 Blount et al. ..... 166/277
5,632,348 5/1997 Yunan ..... 175/4.54
5,651,415 7/1997 Scales ..... 166/250.09
5,660,232 8/1997 Reinhardt ..... 166/297
5,680,905 10/1997 Green et al. ..... 175/4.54
5,690,171 11/1997 Winch et al. ..... 166/63
5,697,445 12/1997 Graham ..... 166/313
5,701,964 12/1997 Walker et al. ..... 175/4.6
5,715,891 2/1998 Graham ..... 166/313
5,720,344 2/1998 Newman ..... 166/243.1
5,727,629 3/1998 Blizzard, Jr. et al. ..... 166/298
5,730,221 3/1998 Longbottom et al. ..... 166/298
5,730,224 3/1998 Williamson et al. ..... 166/386
5,732,773 3/1998 Parks et al. ..... 166/117.5
5,735,350 4/1998 Longbottom et al. ..... 166/313
5,785,130 7/1998 Wesson et al. ..... 175/4.6
5,797,464 8/1998 Pratt et al. ..... 175/4.6
5,799,732 9/1998 Gonzalez et al. ..... 166/250.07
5,814,758 9/1998 Leidel ..... 102/307
5,829,538 11/1998 Wesson et al. ..... 175/4.5
B1 3,706,344 7/1985 Vann ..... 166/297

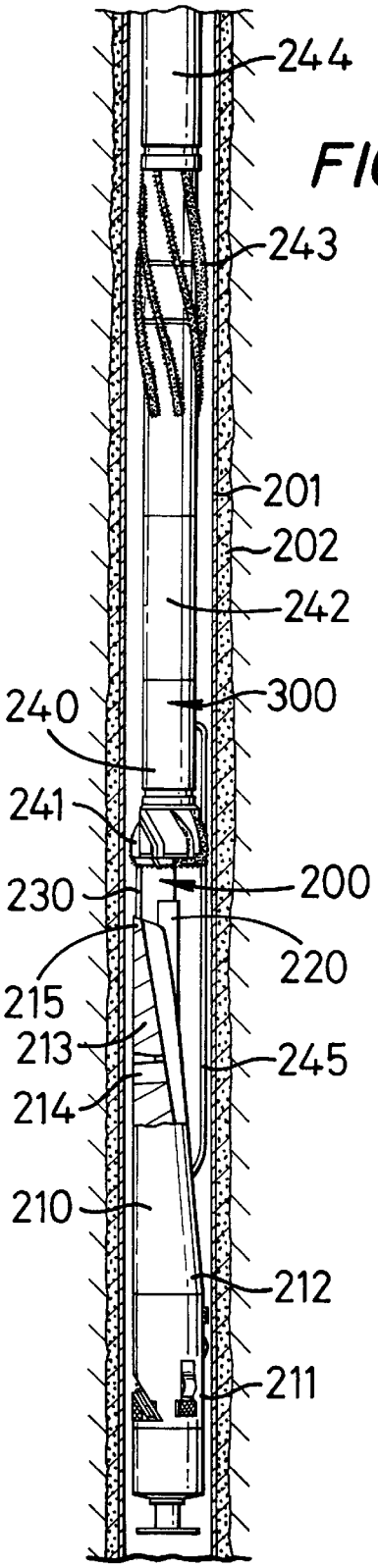
FIG. 7
FIG. 8c
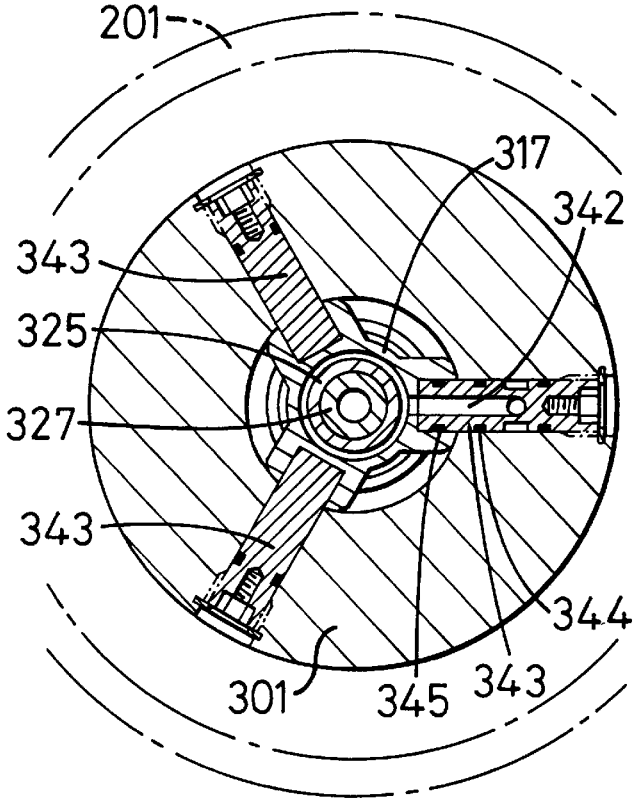

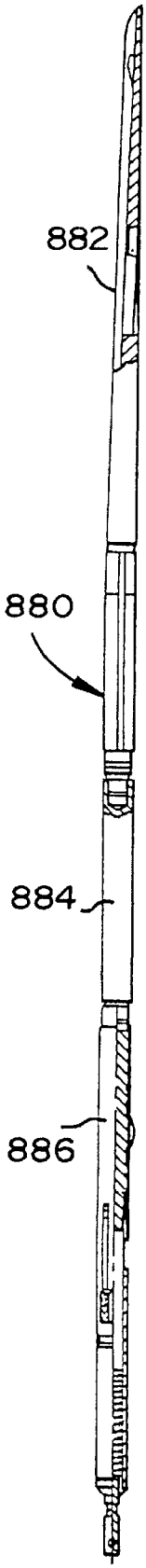
FIG. 42
FIG. 43A
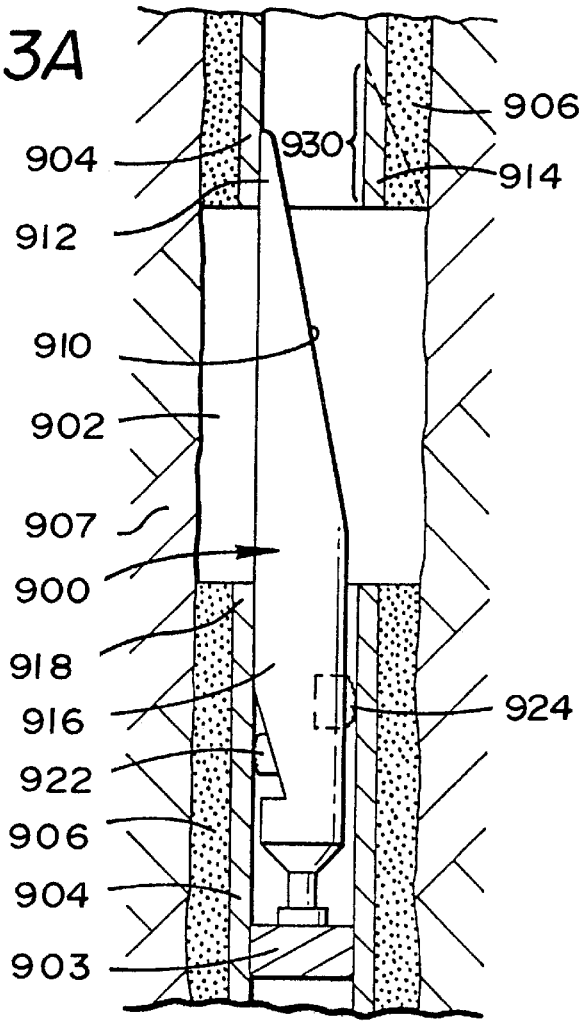
FIG. 43B
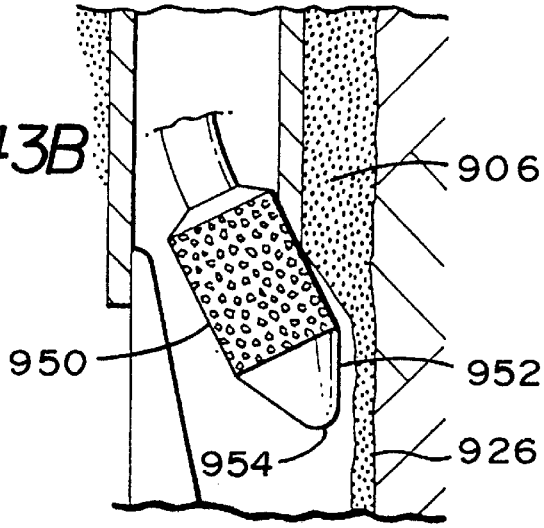

METHOD FOR WINDOW FORMATION IN WELLBORE TUBULARS

RELATED APPLICATIONS

This is a Division of U.S. applications Ser. No. 08/760,283 filed on Dec. 4, 1996 entitled "Tubular Window Formation". Now U.S. Pat. No. 5,791,417, which is a continuation of Ser. No. 08/688,301 filed on Jul. 30, 1996 entitled "Wellbore Window Formation", now U.S. Pat. No. 5,709,265, which is a Continuation-In-Part of pending U.S. application Ser. No. 08/568,878 filed on Dec. 11, 1995 entitled "Casing Window Formation" issued on Jun. 10, 1997 as U.S. Pat. No. 5,636,692, all co-owned with this application and the present invention. Said patent and applications are incorporated fully herein in their entirety for all purposes.

BACKGROUND OF THE INVENTION

1. Field of the Invention

This invention is related to apparatuses and methods for forming a window in a wellbore tubular, e.g. casing, in a wellbore.

2. Description of Related Art

The practice of producing oil from multiple radially dispersed reservoirs, through a single primary wellbore has increased dramatically in recent years. To facilitate this, "kick-off" technology has been developed and continues to grow. This technology allows an operator to drill a vertical well and then continue drilling one or more angled or horizontal holes off of that well at chosen depth(s). Because the initial vertical wellbore is often cased with a string of tubular casing, a "window" must be cut in the casing before drilling the "kick-off". In certain prior art methods windows are cut using various types of milling devices and one or more "trips" of the drill string are needed. Rig time is very expensive and multiple trips take time and add to the risk that problems will occur.

Another problem encountered in certain typical milling operations is "coring". Coring occurs when the center line of a window mill coincides with the wall of the casing being milled (i.e. the mill is half in and half out of the casing). As the mill is rotating, the point at its centerline has a velocity of zero. A mill's capacity to cut casing depends on some relative velocity between the mill face and the casing being cut. When the centerline of the mill contacts the casing wall its cutting capacity at that point is greatly reduced because the velocity near the centerline is very low relative to the casing and zero at the axial centerline. The milling rate may be correspondingly reduced.

Milling tools are used to cut out windows or pockets from a tubular, e.g. for directional drilling and sidetracking; and to remove materials downhole in a well bore, such as pipe, casing, casing liners, tubing, or jammed tools. The prior art discloses various types of milling or cutting tools provided for cutting or milling existing pipe or casing previously installed in a well. These tools have cutting blades or surfaces and are lowered into the well or casing and then rotated in a cutting operation. With certain tools, a suitable drilling fluid is pumped down a central bore of a tool for discharge adjacent or beneath the cutting blades. An upward flow of the discharged fluid in the annulus outside the tool removes cuttings or chips from the well resulting from the milling operation.

Milling tools have been used for removing a section of existing casing from a well bore to permit a sidetracking operation in directional drilling and to provide a perforated production zone at a desired level. Also, milling tools are used for milling or reaming collapsed casing and for removing burrs or other imperfections from windows in the casing system.

Prior art sidetracking methods use cutting tools of the type having cutting blades. A deflector such as a whipstock causes the tool to be moved laterally while it is being moved downwardly in the well during rotation of the tool to cut an elongated opening pocket, or window in the well casing.

Certain prior art well sidetracking operations which employ a whipstock also employ a variety of different milling tools used in a certain sequence. This sequence of operation may require a plurality of "trips" into the wellbore. For example, in certain multi-trip operations, an anchor, slip mechanism, or an anchor-packer is set in a wellbore at a desired location. This device acts as an anchor against which tools above it may be urged to activate different tool functions. The device typically has a key or other orientation indicating member. The device's orientation is checked by running a tool such as a gyroscope indicator or measuring-while-drilling device into the wellbore. A whipstock-mill combination tool is then run into the wellbore by first properly orienting a stinger at the bottom of the tool with respect to a concave face of the tool's whipstock. Splined connections between a stinger and the tool body facilitate correct stinger orientation. A starting mill is releasably secured at the top of the whipstock, e.g. with a shearable setting stud and nut connected to a pilot lug on the whipstock. The tool is then lowered into the wellbore so that the anchor device or packer engages the stinger and the tool is oriented. Slips extend from the stinger and engage the side of the wellbore to prevent movement of the tool in the wellbore; and locking apparatus locks the stinger in a packer when a packer is used. Pulling on the tool then shears the setting stud, freeing the starting mill from the tool. Certain whipstocks are also thereby freed so that an upper concave portion thereof pivots and moves to rest against a tubular or an interior surface of a wellbore. Rotation of the string with the starting mill rotates the mill. The starting mill has a tapered portion which is slowly lowered to contact a pilot lug on the concave face of the whipstock. This forces the starting mill into the casing and the casing is milled as the pilot lug is milled off. The starting mill moves downwardly while contacting the pilot lug or the concave portion and cuts an initial window in the casing. The starting mill is then removed from the wellbore. A window mill, e.g. on a flexible joint of drill pipe, is lowered into the wellbore and rotated to mill down from the initial window formed by the starting mill. A watermelon mill may be used behind the window mill for rigidity; and to lengthen the casing window if desired. Typically then a window mill with a watermelon mill mills all the way down the concave face of the whipstock forming a desired cut-out window in the casing. Then, the window mill is removed and, as a final option, a new window mill and string mill and a watermelon mill are run into the wellbore with a drill collar (for rigidity) on top of the watermelon mill to lengthen and straighten out the window and smooth out the window-casing-open-hole transition area. The tool is then removed from the wellbore.

The prior art discloses a variety of chemical and explosive casing cutters and casing perforators. These apparatuses are used to sever casing at a certain location in a wellbore or to provide perforations in casing through which fluid may flow.

There has long been a need for efficient and effective wellbore casing window methods and tools useful in such methods particularly for drilling side or lateral wellbores. There has long been a need for an effective "single trip" method for forming a window in wellbore casing.

SUMMARY OF THE PRESENT INVENTION

The present invention, in one embodiment, discloses a method for forming an opening in a wellbore casing which includes introducing an apparatus including a whipstock or other drill bit or mill diversion device into the wellbore and locating it at a desired point in the wellbore. In one aspect a drill bit is releasably connected to the diversion device. In one aspect a window mill is releasably connected to the whipstock. To create a hole through which drilling of the formation adjacent the hole is possible or to initiate a starting hole or slot for milling in the casing, a shaped charge of explosive is attached to the apparatus. In one aspect the charge is attached to a drill bit; in one aspect to the diversion device; and in another aspect to the window mill. In one aspect the charge is attached below the window mill. The explosive charge is properly designed to form a hole of desired shape and configuration in the casing without damaging the whipstock, drill bit, window mill, or adjacent casing; and, in certain aspects, to form the beginning of a lateral bore in formation adjacent to a wellbore tubular. The explosive is also designed to create a minimum of debris in the wellbore.

In certain embodiments the size, shape, and character of the hole created by the explosive charge is directly dependant on the design of the charge. The relationship between the shape of the charge and the shape of the hole is known as the "Munroe effect"; i.e., when a particular indentation is configured in the "face" of an explosive charge, that configuration is mirrored in a target when the charge is detonated adjacent to the target. Additional enhancement of desired final target configurations is obtained by the use of multiple precision timed explosive initiation, explosive lensing, and internal explosive wave shaping.

In one embodiment an explosive charge (e.g. a linear jet shape charge) is run into a cased wellbore with a whipstock so that the charge is directed 180 degrees from the whipstock concave. It is detonated at the depth that corresponds to the depth of the window mill at which coring is anticipated. This charge cuts an axial slot out of the casing wall so that when the mill encounters the slot, there is no casing on its centerline (casing in that area having been previously removed by the charge), thus preventing coring.

The present invention, in certain embodiments, discloses an apparatus for forming an opening in casing in a cased wellbore, the apparatus having a location device for locating the apparatus in the casing, and an explosive device interconnected with the location device for explosively forming an opening in the casing; in one aspect the opening being a window suitable for wellbore sidetracking operations; such apparatus with the location device including an orienting device for orienting the explosive means radially within the wellbore and the location device including a diversion device for directing a drill bit or a mill; and drill bit for drilling into the formation adjacent the opening or a milling apparatus for milling the casing at the opening, the milling apparatus releasably attached to the location means; such apparatus with the location device having a whipstock with a concave, and milling device or devices for milling the casing releasably connected to the location means; such apparatus wherein the milling device is a window mill; such apparatus wherein the milling devices include at least two mills; such an apparatus wherein the location device includes an anchor apparatus for anchoring the location device in the wellbore; such an apparatus wherein the explosive device is connected to the diversion device and the apparatus has at least one explosive charge sized, configured and located for producing an opening, slot, radial ledge or completed window of a desired size, shape and location in the casing, and a detonator device for detonating the at least one explosive charge; such apparatus wherein the at least one explosive charge is a plurality of explosive charges; such an apparatus wherein the detonator device includes a timer for activating the detonator device at a desired time; such an apparatus including a sequence device for activating the explosive prior to drilling or prior to milling of casing by a mill or mills; such an apparatus wherein the at least one explosive charge is sized, shaped, configured and located so that the opening defines an opening, e.g. a slot, in the casing located to inhibit or prevent coring of a mill milling at the window.

The present invention, in certain embodiments, discloses an apparatus for forming a window in casing in a cased wellbore, the apparatus having a location device for locating the apparatus in the casing; an explosive device interconnected with the location device for explosively forming a window in the casing, the explosive device including at least one explosive charge sized, configured and located for producing a window of a desired size, shape and location in the casing; and a detonator device for detonating the at least one explosive charge; the location device including a whipstock with a concave, and an anchor device for anchoring the location device in the wellbore; and milling apparatus releasably connected to the location device, the milling apparatus including a window mill and/or another mill or mills.

The present invention, in certain embodiments, discloses an apparatus for forming a window in casing in a cased wellbore, the apparatus having a location device for locating the apparatus in the casing, and an explosive device connected to the location device for explosively forming a slot in the casing, the slot defining an opening in the casing located to inhibit or prevent coring of a mill milling at the slot; such an apparatus wherein the location device includes a whipstock with a concave, and the apparatus further has milling apparatus releasably connected to the location means; such an apparatus with the milling apparatus including a window mill; such an apparatus wherein the location device has an anchor device for anchoring the location device in the wellbore; such an apparatus wherein the explosive device has at least one explosive charge sized, configured and located for producing a slot of a desired size, shape and location in the casing, and a detonator device for detonating the at least one explosive charge.

The present invention, in certain embodiments, discloses an apparatus for forming a radial ledge in casing in a cased wellbore, the apparatus having a location device for locating the apparatus in the casing, and an explosive device connected to the location device for explosively forming a radial ledge in the casing, the ledge defining an opening in the casing located to enhance initial casing penetration by a mill milling at the ledge.

The present invention, in certain embodiments, discloses an apparatus for forming a window in casing in a cased wellbore, the apparatus having a location device for locating the apparatus in the casing, and an explosive device connected to the location device for explosively forming a radial ledge and an axial slot in the casing, the combined configuration defining an opening in the casing located to enhance initial casing penetration by a mill, and inhibit or prevent coring of a mill milling at the slot; such an apparatus wherein the mill is releasably attached to the location device; such an apparatus wherein the explosive device is attached to the mill; and such an apparatus wherein the location device has a whipstock with a concave, and the apparatus includes milling apparatus for milling casing releasably connected to the location means.

The present invention, in certain embodiments, discloses a method for forming an opening in a casing of a cased wellbore, the method including locating an opening-forming system at a desired location in casing in a wellbore, the opening-forming system having a location device for locating the apparatus in the casing, and an explosive device connected to the location device for explosively forming an opening in the casing, the opening for facilitating wellbore sidetracking operations, the explosive device including an explosive charge, and the method including exploding the explosive charge adjacent the casing to explosively form the opening; such a method wherein a drill bit is connected to the location device and the method including drilling formation adjacent the opening created by the opening-forming system; such a method wherein the location device includes a whipstock with a concave, and the apparatus device has milling apparatus releasably connected to the location device and the method includes milling at the opening with the milling means; such a method wherein the at least one explosive charge is sized, shaped, configured and located so that the opening created in the casing is located to inhibit or prevent coring of a mill milling at the opening; and such a method wherein the opening includes a radial ledge in the casing for facilitating casing penetration by a mill milling at the ledge.

It is, therefore, an object of at least certain preferred embodiments of the present invention to provide:

New, useful, unique, efficient, non-obvious methods and systems for the formation of an opening in a wellbore tubular;

Such systems with an explosive charge for initiating a hole in a wellbore tubular, e.g, tubing or casing;

Such systems in which the opening is a window suitable for sidetracking operations;

Such systems useful for milling casing and, in one aspect, for removing a portion of a casing, e.g. a longitudinal slot, to inhibit or prevent mill coring;

Such systems for forming a radial ledge in casing for facilitating milling of the casing;

Such systems which product minimal debris upon activation;

Such systems with which a casing window is formed in a single trip in the hole; and Methods employing such systems for creating an opening; for subsequent milling of casing.

This invention resides not in any particular individual feature disclosed herein, but in combinations of them and it is distinguished from the prior art in these combinations with their structures and functions. There has thus been outlined, rather broadly, features of the invention in order that the detailed descriptions thereof that follow may be better understood, and in order that the present contributions to the arts may be better appreciated. There are, of course, additional features of the invention that will be described hereinafter and which may be included in the subject matter of the claims appended hereto. Those skilled in the art who have the benefit of this invention will appreciate that the conceptions, upon which this disclosure is based, may readily be utilized as a basis for the designing of other structures, methods and systems for carrying out the purposes of the present invention. It is important, therefore, that the claims be regarded as including any legally equivalent constructions insofar as they do not depart from the spirit and scope of the present invention.

The present invention recognizes and addresses the previously-mentioned problems and needs and provides a solution to those problems and a satisfactory meeting of those needs in its various possible embodiments and equivalents thereof. To one of skill in this art who has the benefits of this invention's realizations, teachings and disclosures, other and further objects and advantages will be clear, as well as others inherent therein, from the following description of presently-preferred embodiments, given for the purpose of disclosure, when taken in conjunction with the accompanying drawings. Although these descriptions are detailed to insure adequacy and aid understanding, this is not intended to prejudice that purpose of a patent which is to claim an invention as broadly as legally possible no matter how others may later disguise it by variations in form or additions of further improvements.

DESCRIPTION OF THE DRAWINGS

So that the manner in which the above-recited features, advantages and objects of the invention, as well as others which will become clear, are attained and can be understood in detail, more particular description of the invention briefly summarized above may be had by references to certain embodiments thereof which are illustrated in the appended drawings, which drawings form a part of this specification. It is to be noted, however, that the appended drawings illustrate certain preferred embodiments of the invention and are therefore not to be considered limiting of its scope, for the invention may admit to other equally effective or equivalent embodiments.

FIG. 7 is a side view in cross-section of a system according to the present invention.

FIG. 8*c* is a cross-section view along line 8*c*—8*c* of FIG. 8*b*.

FIGS. 19*b* and 19*c* are schematic side views in cross-section showing steps in a method of use of the system of FIG. 21*a*.

FIG. 42 is a side view partially in cross-section, of a whipstock according to the present invention.

FIG. 43A is a side view in cross-section of a whipstock emplaced across a milled-out casing section in a wellbore according to the present invention. FIG. 43B shows milling in the wellbore of FIG. 43A according to the present invention.

DESCRIPTION OF EMBODIMENTS PREFERRED AT THE TIME OF FILING FOR THIS PATENT

Figure 1:
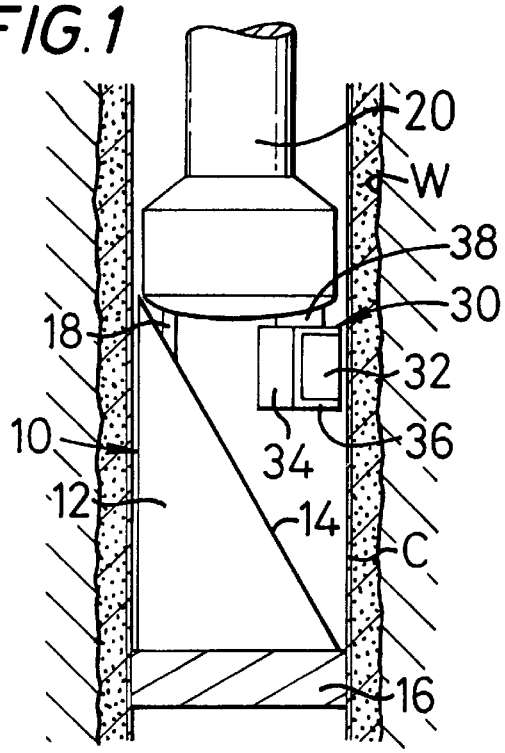
FIG. 1 is a side cross-sectional view of a system according to the present invention.

Referring now to FIG. 1, a system 10 according to the present invention is shown schematically in a wellbore W cased with casing C. The system 10 includes a whipstock 12 with a concave face 14 anchored by an anchor device 16 in the wellbore W. A window mill 20 is releasably connected to the whipstock 12 e.g. with a shear stud 18 (or with an hydraulic release device).

An explosive charge system 30 is secured to the whipstock 12 (e.g. by any suitable securement apparatus, device, or method) (or to the window mill 20). Shock attenuation material 36 is preferably disposed on the sides of the explosive charge except the side facing the casing. The system 30 includes a typical amount of an explosive 32 and a typical detonator device 34. The explosive 32 may be detonated at a desired moment in time using any suitable known apparatus or mechanism.

Detonation may be effected by employing drill string pressure, annulus pressure, pressure sequencing, mechanical devices (e.g. bar drop through drill string I.D.), or electric wireline run.

The explosive 32 is sized and configured to create a hole in the casing of desired size, location, and configuration. The window mill 20 is located so that it takes advantage of the hole created by the system 30 and can complete the formation of a window in the casing in a single trip of the system 10 into the hole.

Figure 2:
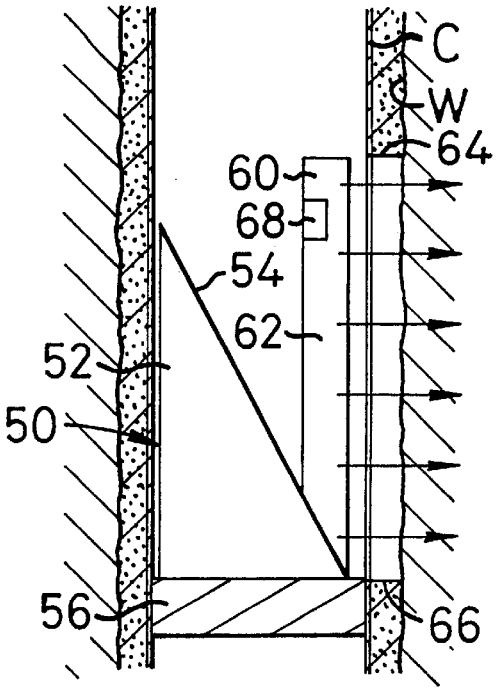
FIG. 2 is a side cross-sectional view of a system according to the present invention.

FIG. 2 illustrates schematically a system 50 according to the present invention in a wellbore W cased with casing C. The system 50 with a concave face 54 anchored in the wellbore W with an anchor 56.

An explosive charge system 60 is secured to the whipstock 52 and is shaped, sized, and configured to form a slot in the casing C between the points 64, 66. Rather than encountering casing and producing coring of a mill (not shown; like the window mill 20, FIG. 1), a mill encounters the slot and coring is inhibited or prevented. Preferably the explosive charge system 60 is self-consuming and no part of it remains after the explosion on the whipstock or in the slot to inhibit subsequent milling. The system 60 may include any known mill or multiple mill combination. The system 60 includes an amount of known explosive 62 and a detonator apparatus 68. The whipstock 52 may be any known whipstock or mill diversion device; the whipstock 52 may be a hollow whipstock. The arrows in FIG. 2 indicate the direction of the effects of the explosion of the explosive 62.

Figure 3:
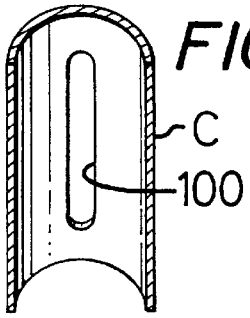
FIG. 3 is a schematic view of a slot formed in casing using a system according to the present invention.

FIG. 3 shows casing C with a slot 100 formed therethrough explosively with a system according to the present invention as described above at a desired location for a completed window for wellbore sidetracking operations. Additional milling at the slot will complete a window and, as a mill moves down the slot coring of the mill when it is half in and half out of the casing is inhibited or prevented.

Figure 4:
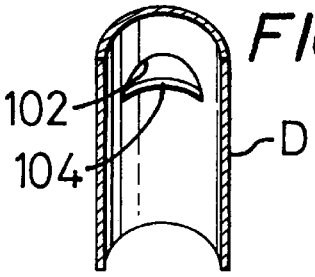
FIG. 4 is a schematic view of a radial ledge opening formed in casing using a system according to the present invention.

FIG. 4 shows a casing D with a hole 102 and a radial ledge 104 therethrough formed explosively with a system according to the present invention. Such a hole and ledge facilitate initial milling starting at the location of the ledge.

Figure 5:
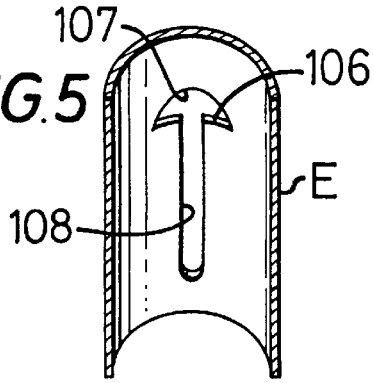
FIG. 5 is a schematic view of an opening in casing including a radial ledge and a slot formed using a system according to the present invention.

FIG. 5 shows a casing E with a composite opening formed explosively with a system as described above with a ledge 106 (like the ledge 104), a hole 107 (like the hole 102), and a slot 108 (like the slot 100) to facilitate milling at the location of the ledge and slot.

Figure 6:
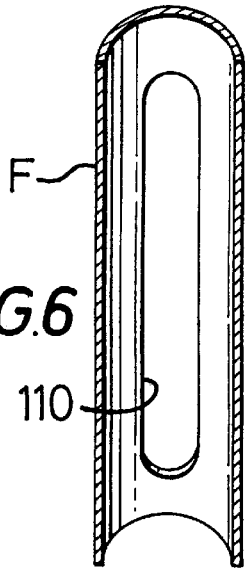
FIG. 6 is a schematic view of a window opening formed in casing using a system according to the present invention.

FIG. 6 shows a casing F with a completed wellbore sidetracking window 110 formed explosively with a system as described above.

FIG. 7 shows a system 200 according to the present invention which has a whipstock 210, an explosive device 220, an extender 230, and a milling apparatus 240. The system 200 is in a string of casing 201 in a wellbore 202.

The whipstock 210 may be any known diverter, mill guide or whipstock, including, but not limited to, concave-hinged and concave-integral whipstocks, solid whipstocks, hollow whipstocks, soft-center whipstocks, retrievable whipstocks, anchor whipstocks, anchor-packer whipstocks, bottom set whipstocks, and permanent set whipstocks. As shown the whipstock 210 is any hydraulic set whipstock with a lower hydraulically-set anchor apparatus 211, a body 212, a concave 213, a retrieval slot 214, and a top end 215.

The milling apparatus 240 is spaced-apart from and interconnected with the whipstock 210 by the extender 230. The extender 230 may be made of any suitable material, including but not limited to steel, mild steel, stainless steel, brass, fiberglass, composite, ceramic, cermet, or plastic. In one aspect brass is used because it is easily millable. One, two, three or more extenders may be used. The extender 230 spaces the milling apparatus away from the area of maximum explosive effect and permits the explosive device 220 to extend above the top of the concave 213 so that an opening is formed in the casing 201, thus facilitating the initiation of milling at a point above or even with the top end 215 of the concave 213. Shear pins 324 pin the extender 230 to the mill 241.

The explosive device 220 may be any known explosive device suitable for making a desired hole or opening in the casing 201. As shown the explosive device 220 is positioned adjacent the concave 213 with a portion extending above the concave 213. The explosive device may be positioned at any desired point on the concave 213. Alternatively it may be secured to the extender 230 or it may be suspended to and below the milling apparatus 240.

The milling apparatus 240 may be any suitable milling or drilling apparatus with any suitable known bit, mill or mills. As shown the milling apparatus 240 has a starting mill 241, a firing head 300, a tubular joint 242 and a watermelon mill 243 which is connected to a tubular string 244 that extends to the surface. The milling apparatus 240 may be rotated by a downhole motor in the tubular string 244 or by a rotary table. An hydraulic fluid line 245 extends from the firing head 300 to the whipstock 210. The hydraulic fluid line 245 intercommunicates with a pressure fluid supply source at the surface (not shown) via an internal bore of a body of the firing head 300 and fluid under pressure is transmitted through the fluid line 245, through the whipstock 210, to the anchor apparatus 211.

Figure 8A:
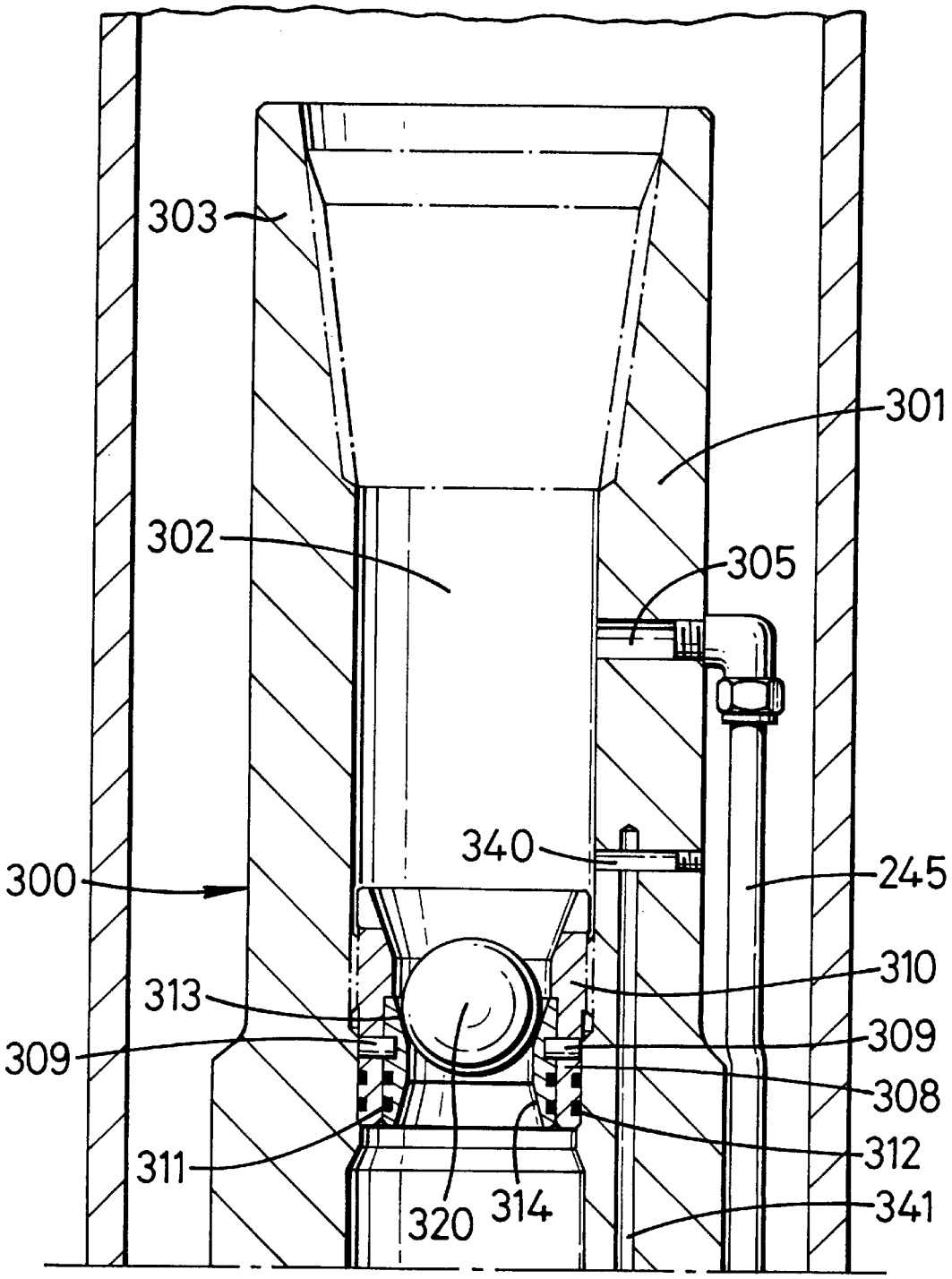
FIG. 8*a* and 8*b* are a cross-section views of a firing head and mill of the system of FIG. 7.
Figure 8B:
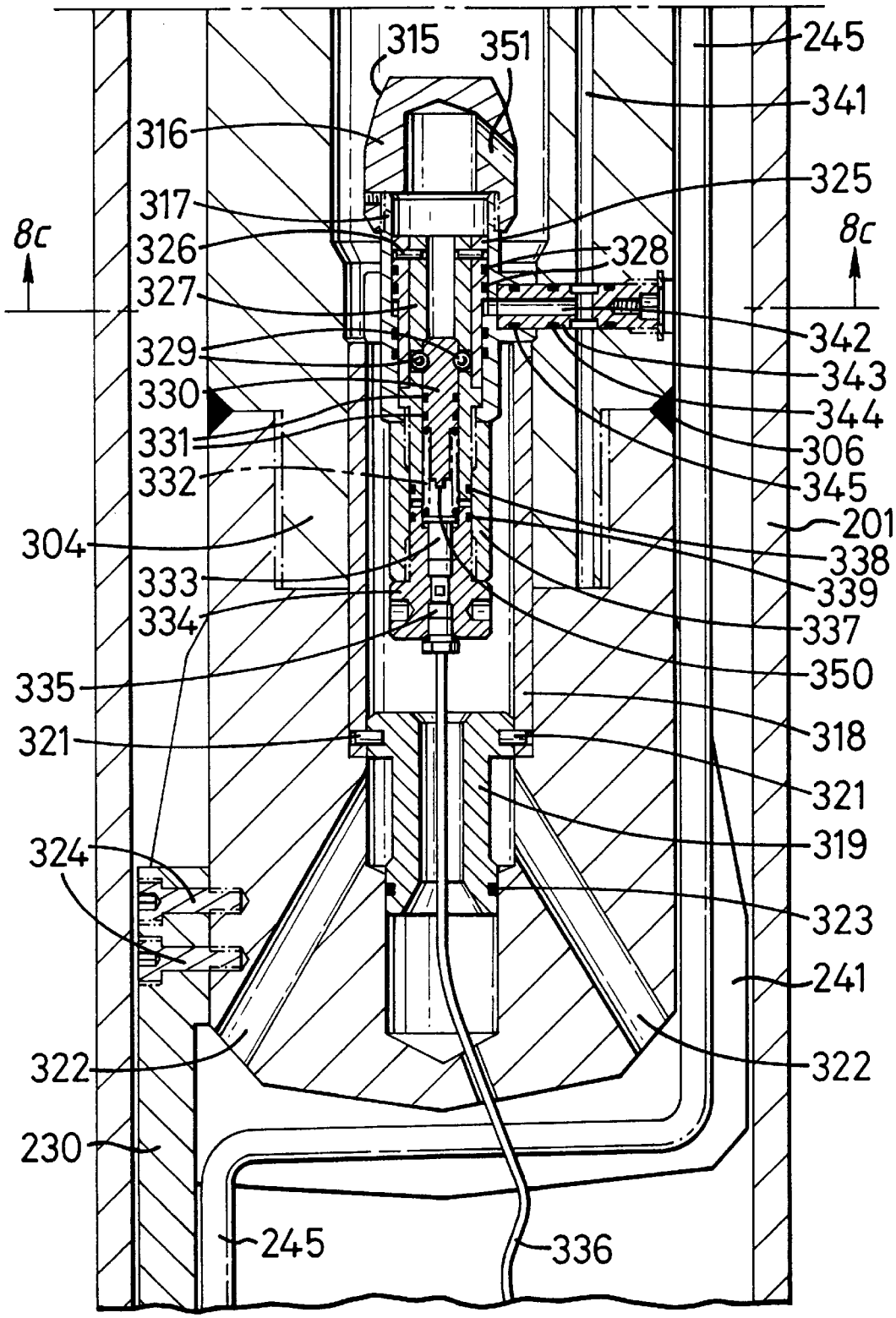
Figure 9:
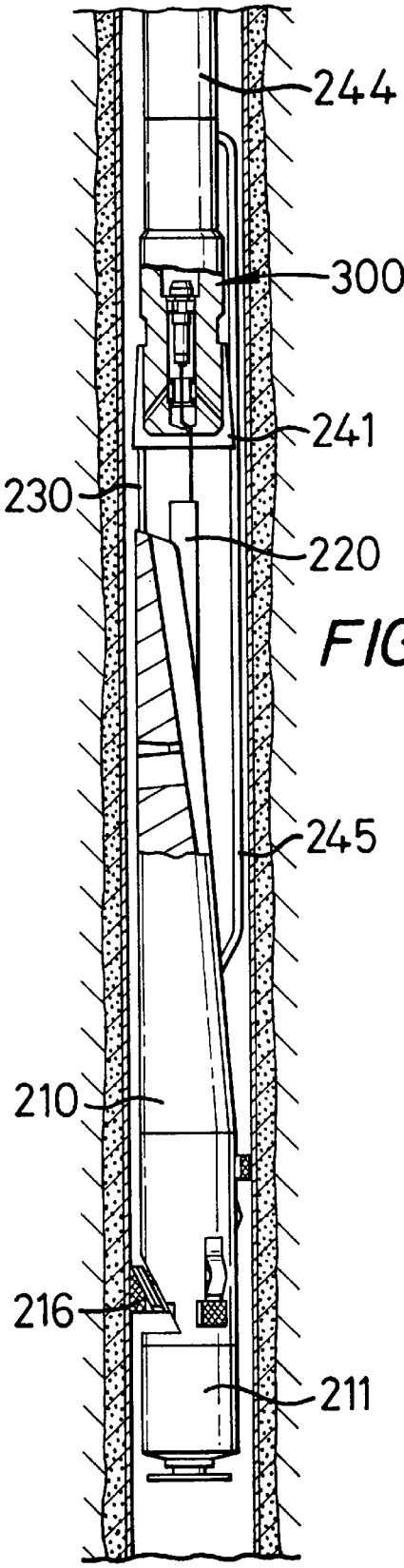
FIGS. 9–13 are side cross-section views that illustrate steps in a method of use of the system of FIG. 7.

As shown in FIGS. 8*a* 8*b,* and 8*c* the firing head 300 has a body 301 with a fluid bore 302 extending therethrough from a top end 303 to a bottom end 304. The fluid line 245 is in fluid communication with the bore 302 via a port 305. The body 301 may be an integral part as shown welded at 306 to the mill 241. This firing head may be used in or with a mill or in or with a bit.

A ball seat 308 is shear-pinned with one or more pins 309 to a ball guide 310. A seal 311 seals the ball-seat-ball-guide interface and a seal 312 seals the ball-guide-body interface. The ball seat 308 has a seating surface 313 against which a ball 320 can sealingly seat to stop flow through the bore 302. The ball guide 310 may be threadedly secured to the body 301.

A tapered surface 314 on the ball seat 308 is fashioned and shaped to facilitate reception of a tapered upper portion 315 of a tower 316 when the pins 309 are sheared and the ball seat 308 moves down in the body 301. The tower 316 is threadedly secured to a body 317 which is mounted on an inner sleeve 318 in the bore 302. A mid body 337 spaces apart the body 317 and a lower body 334. A sleeve 319 is shear pinned with one or more pins 321 to the inner sleeve 318. Initially the sleeve 319 prevents fluid flow to mill ports 322. A seal 323 seals the sleeve-body interface. A seal 338 seals the mid-body-cylinder interface. A seal 339 seals the lower-body-mid-body interface.

A movable piston 325 is initially held in place in the body 317 by shear pins 326 that pin the piston 325 to a cylinder 327. Seals 328 seal the piston-body interface. Balls 329 initially hold a firing piston 330. The balls 329 are initially held in place in holes in the cylinder 327 and prevented from moving out of the holes by the piston 325, i.e., from moving outwardly to free the firing piston 330. Seals 331 seal the firing-piston-cylinder interface.

When the firing piston 330 is freed, a spring 332 urges it away from a percussion initiator 333. The percussion initiator 333 is mounted at a top end of the lower body 334. A booster detonator 335 is held in a lower end of the lower body 334 and is situated to receive the effects of the percussion initiator 333 (e.g., a known and commercially available percussion initiator with a "flyer" that is explosively directed away from the initiator upon detonation). The booster detonator 335 is interconnected with detonation cord 336. Fluid under pressure flows selectively through a port 340 from the bore 302 to a bore 341 which is in fluid communication with bores 342 through liners 343 (see FIG. 8*c*). Fluid from the bore 342 acts on the movable piston 325. A seal 344 seals the liner-body 301 interface. A seal 345 seals the liner-body 317 interface.

Figure 10:
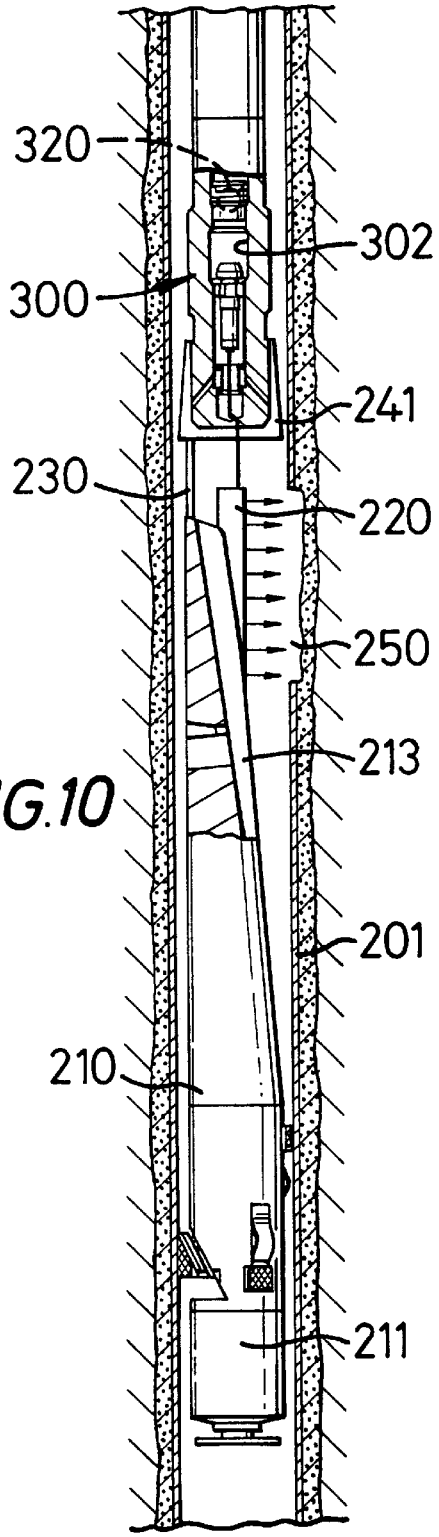

As shown in FIG. 10, a ball 320 has dropped to close off flow through the bore 302 and the pressurized fluid applied through the bore 342 has sheared the pins 326 freeing the movable piston 325 for upward movement due to the force of the fluid. This in turn allows the balls 329 to move outwardly freeing the firing piston 330 (which has a captive fluid e.g. air below it at a pressure less than the hydrostatic pressure above the piston, e.g. air at atmospheric pressure below the piston) so that its firing pin 350 strikes the percussion initiator 333. The percussion initiator 333 detonates and (as is typical) its flyer plate is directed by detonation of the percussion initiator 333 to the detonator booster 335 which in turn detonates the detonator booster 335, detonation cord 336, and hence the explosive device 220, creating an opening 250 in the casing 201.

Figure 11:
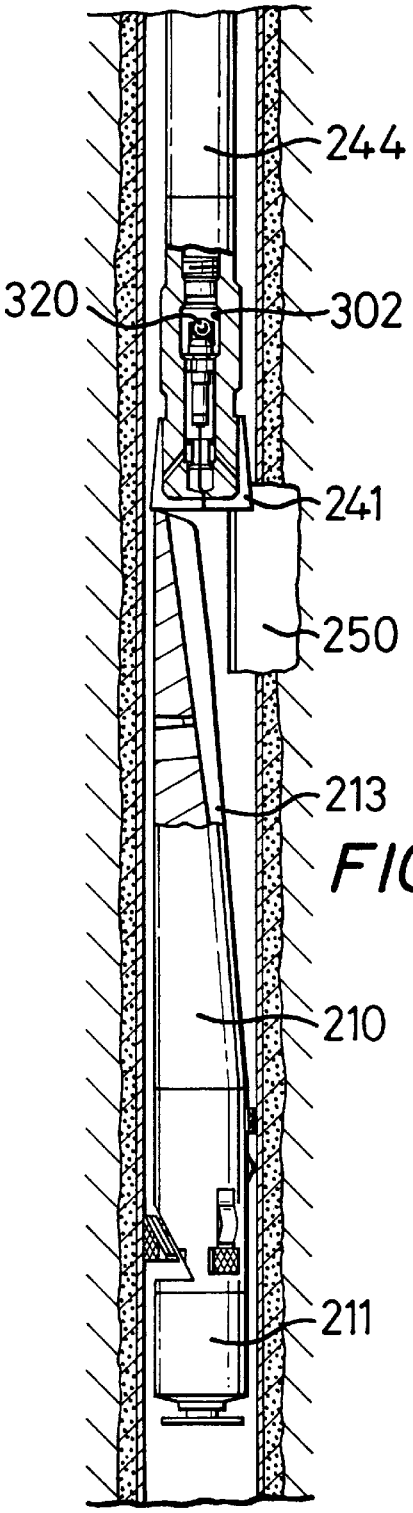
Figure 12:
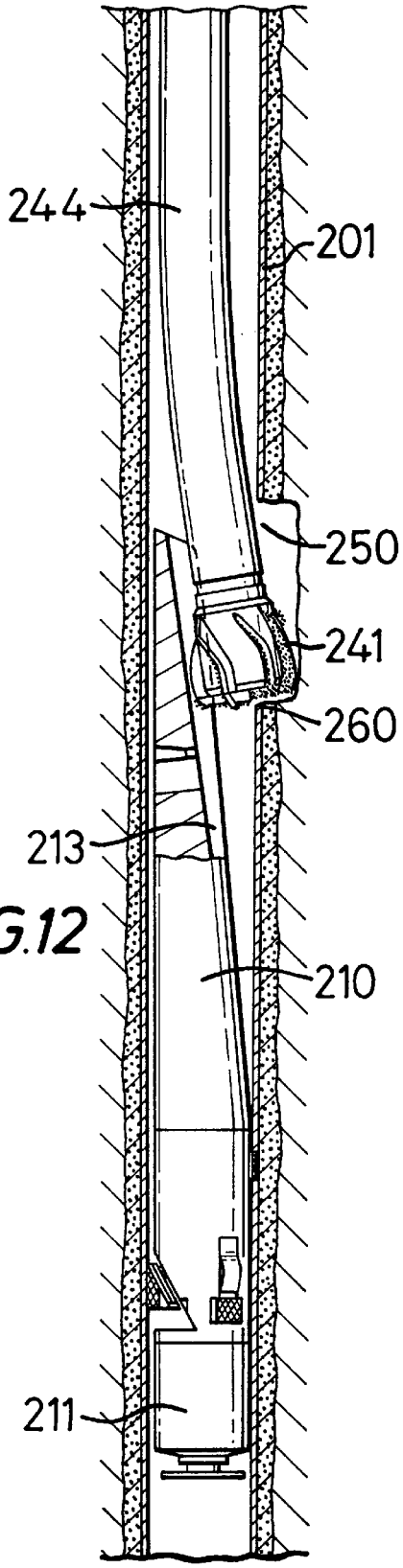

As shown in FIG. 11, fluid pressure through the bore 302 has been increased so that the pins 309 are sheared and the ball 320 and ball seat 308 move down onto the tower 316. In this position (as in the position of FIG. 7) fluid flows between the ball seat 308 and the interior wall of the body 301 into and through a port 351 into a space below the tower 316 and above a top end of the firing piston 330. Fluid flows down to the sleeve 319 between the liners 343, through the bore 302 between the sleeve 318 and the mid body 337, to the space adjacent the sleeve 319 to shear pins 321 to permit fluid to circulate through ports 322 for milling. The mill 241 has been raised, lowered, or rotated to shear the pins 324 and the mill 241 has milled away the extender 230. As shown in FIG. 11, the mill 241 has progressed downwardly and is adjacent the opening 250. As shown in FIG. 12, the mill 241 has milled the casing 201 beyond the opening 250 and has commenced milling a desired window 260. The mill 241 is moving down the concave 213.

Figure 13:
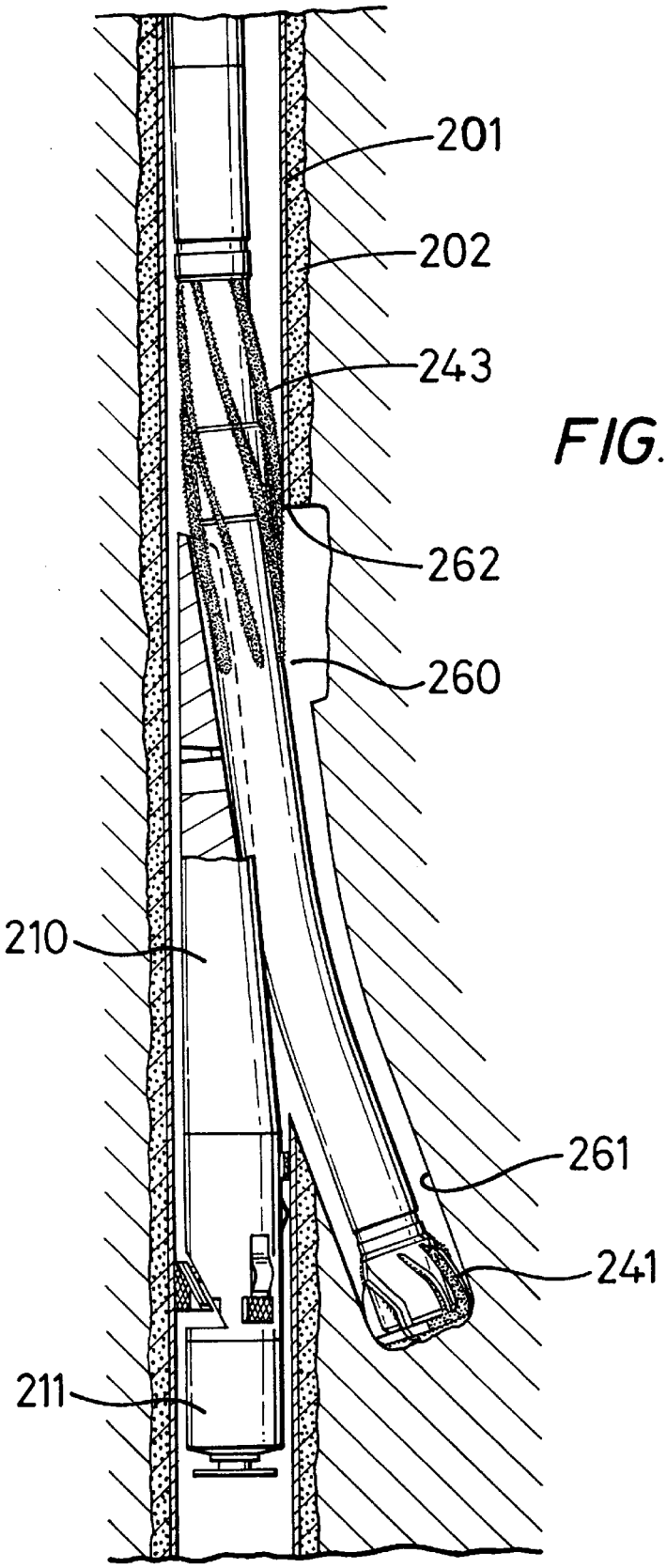
Figure 14:
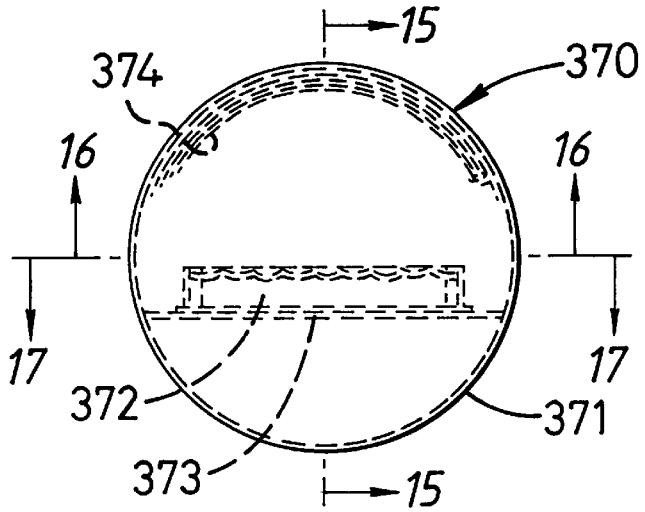
FIG. 14 is a top cross-section view of an explosive device useful in the system of FIG. 7.
Figure 15:
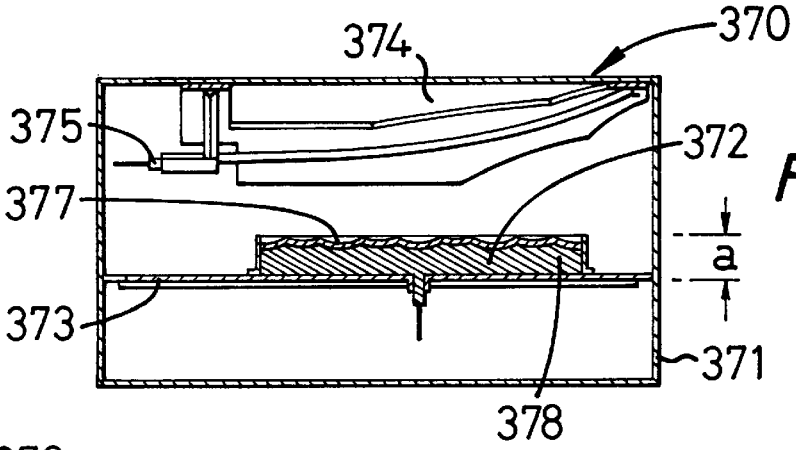
FIG. 15 is a cross-section view along line 15—15 of FIG. 14.
Figure 16:
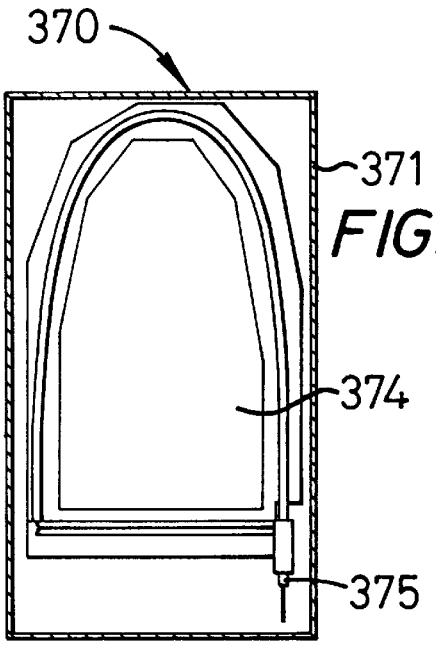
FIG. 16 is a cross-section view along line 16—16 of FIG. 14.
Figure 17:
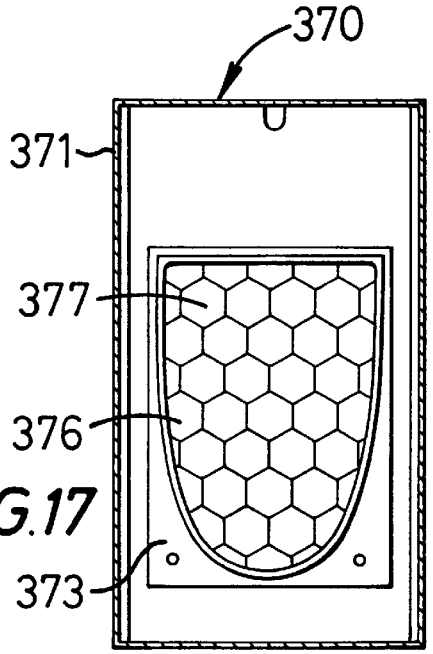
FIG. 17 is a cross-section view slong line 17—17 of FIG. 14.

FIG. 13 illustrates the completed window 260 and a lateral bore 261 extending from the main wellbore 202. The watermelon mill 243 has begun to mill an edge 262 of the casing 201.

The system 200's firing mechanism is isolated from a hydrostatic head of pressure in an annulus between the firing head's exterior and the interior casing wall. Thus the firing head does not fire unless a ball is dropped as described above. The spring 332 guarantees that the firing pin does not strike the percussion initiator 333 unless and until the force of the spring is overcome. In one aspect the spring force is chosen so that it must be overcome by the hydrostatic pressure of fluid introduced above the firing piston. In one aspect the spring force is above the force of atmospheric pressure so unplanned firing does not occur at the surface. Fluid introduced on top of the firing piston 330 inhibits the introduction of debris, junk, etc. there and its accumulation there, i.e., material that could adversely affect the firing piston or inhibit or prevent firing; thus, preferably, i.e. a substantially static fluid regime is maintained within the tower and above the firing piston.

FIGS. 14–17 show an explosive device 370 for use as an explosive device 220 as described above (or for any other explosive device disclosed herein). It should be understood that any suitable explosive device may be used, including but not limited to: a jet charge, linear jet charge, explosively formed penetrator, multiple explosively formed penetrator, or any combination thereof. The device 370 has a housing 371 made, e.g. of plexiglass, fiberglass, plastic, or metal. A main explosive charge 372 secured to a plexiglass plate 373 is mounted in the housing 371. A linear jet explosive charge 374 with a booster detonator 375 is also mounted in the housing 371. The distance "a" in FIG. 15 in one embodiment is about 1.35 inches.

The main explosive charge 372 includes a liner 377 with a series of hexagonal discs 376 of explosive each about 0.090 inches thick. The discs 376 are, in certain embodiments, made of metal, e.g. zinc, aluminum, copper, brass, steel, stainless steel, or alloys thereof. A main explosive mass 378 is behind the discs 376. In one aspect this explosive mass is between about one half to five-eights of a kilogram of explosive, e.g. RDX, HMX, HNS, PYX, C4, or Cyclonite. In one aspect the liner 377 is about 8.64 inches high and 5.8 inches wide at its lower base.

Preferably the linear jet charge 374 is formed and configured to "cookie cut" the desired window shape in the casing and then the main charge 372 blows out the window preferably fragmenting the casing and driving it into the formation. By appropriate use of known timers and detonation cord, the linear jet charge can be exploded first followed by the main charge. Alternatively the two charges can be fired simultaneously.

At any location in the system 200 appropriate known explosive shock attenuation devices may be employed, including but not limited to materials having varying sound speeds, (e.g. a sandwich of rubber-plastic-rubber-plastic) and collapsing atmospheric chambers. Such devices may be placed above or below the charge or between the charge and any other item in the system, e.g. the whipstock, the extender, or the mill(s). The charge may be embedded in the concave at any point in the concave and, in one aspect, at the top of the concave. The charge alone may be introduced into a cased wellbore on a rope, cable, wireline, slickline or coiled tubing. Following positioning and orientation, the charge is fired to create a desired opening, ledge, lateral bore through casing and in one aspect at some distance into formation, or window in the casing. The rope, etc. is then removed and cutting, reaming, milling, drilling, and/or milling/drilling apparatus is introduced into the wellbore and moved to the location of the desired opening, etc. for further operations.

Figure 18A:
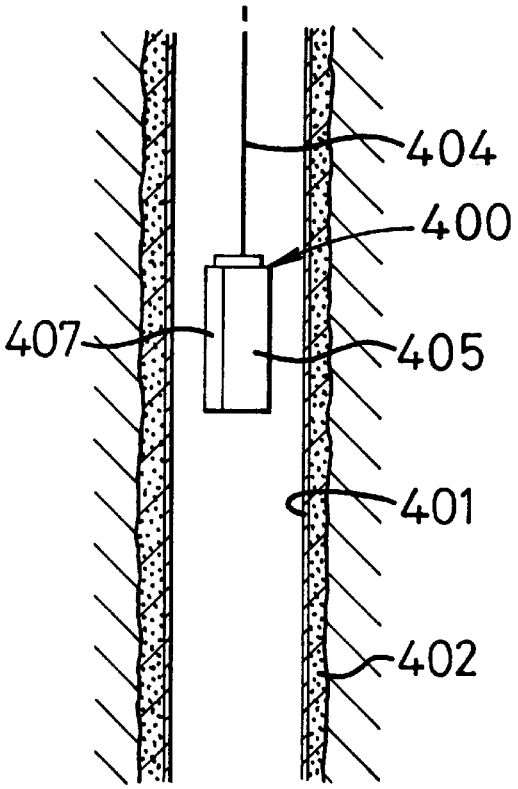
FIG. 18*a* is a schematic side view in cross-section of a system according to the present invention.
Figure 18B:
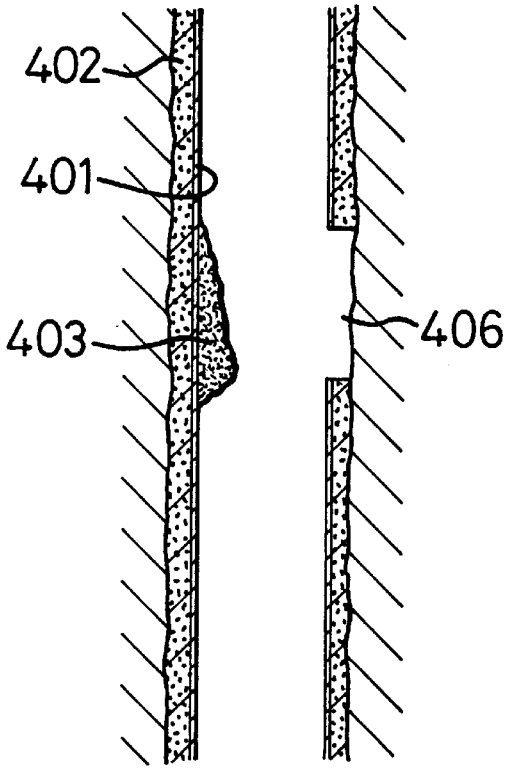
FIG. 18*b* shows a diverter produced in the wellbore of FIG. 18*a* by the system of FIG. 18*a*.

FIGS. 18A and 18B disclose a system 400 for explosively forming an opening in a casing 401 in a wellbore 402 and for explosively forming a whipstock mill or bit or a diverter 403 on an interior casing wall. The system 400 apparatus is lowered (see FIG. 18A) into the wellbore 402 on a line 404. Known orienting apparatus assures correct orientation of the system. The explosive apparatus includes a main charge 405 for forming an opening 406 and a secondary charge with a body of material 407 for forming the diverter 403. In one aspect only one charge is used, but a body of material is used to form the diverter. As shown in FIG. 18B the explosion of the charge(s) has produced the diverter 403 explosively welded to or embedded in the casing 401 adjacent the opening 406. Instead of the mass of material, a formed diverter, wedge, or whipstock apparatus may be used which is explosively forced into or onto the casing 401.

FIGS. 19A–19D disclose a system 420 for explosively forming an opening 426 through a casing 421 in a wellbore 422 and for explosively forming a mill or bit diverter 423 in or on the interior casing wall. The system 420 is lowered on a line 424 to a desired position in the wellbore 422. A first charge 427 is fired to produce the opening 426. Then a second charge 428 with a mass of material included therein is lowered to a location adjacent the opening 426. Firing of the second charge 428 produces the diverter 423. Alternatively, the second charge 428 may be used to embed an already-formed diverter, wedge or whipstock in or on the casing wall.

Figure 20A:
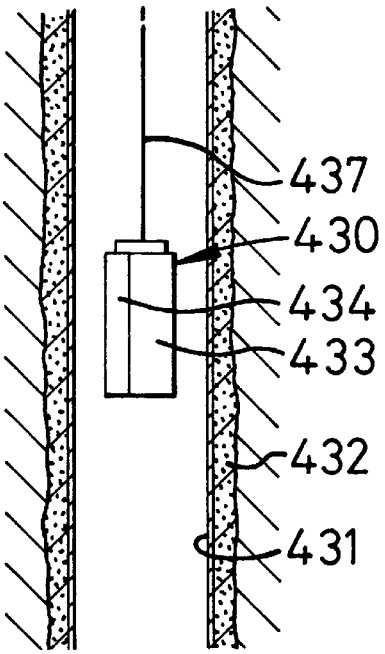
FIG. 20*a* is a schematic side view in cross-section of a system according to the present invention.
Figure 20B:
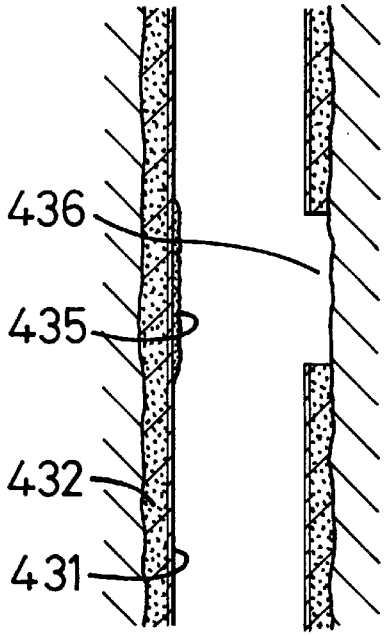
FIG. 20*b* shows a hardened area in the wellbore of FIG. 20*a* made by the system of FIG. 20*a*.
Figures 19A, 19B, 19C, 19D:
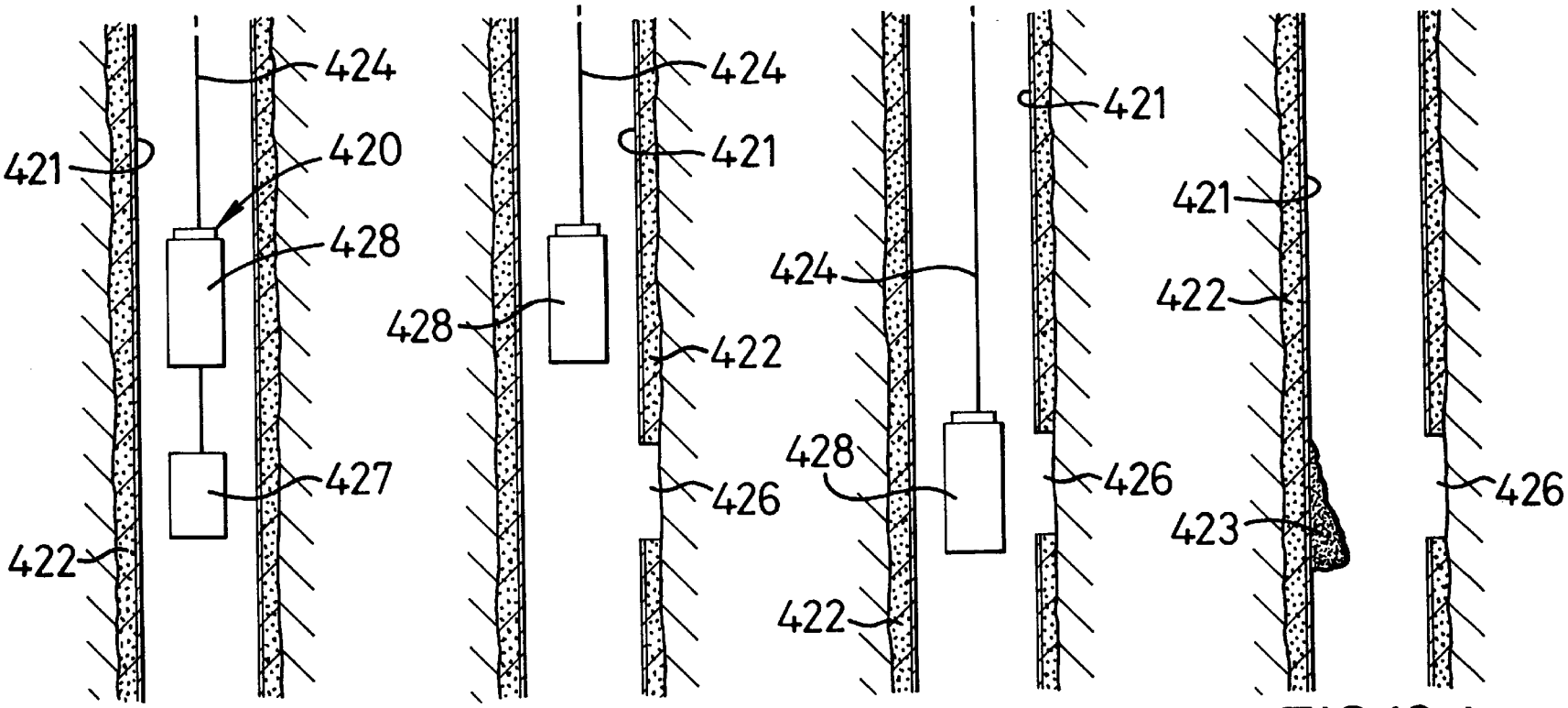
FIG. 19*a* is a schematic side view in cross-section of a system according to the present invention.
FIGS. 19*b* and 19*c* are schematic side views in cross-section showing steps in a method of use of the system of FIG. 19*a*.
FIG. 19*d* shows a diverter in the wellbore of FIG. 19*a* made by the system of FIG. 19*a*.
Figures 21A, 21B, 21C, 21D:
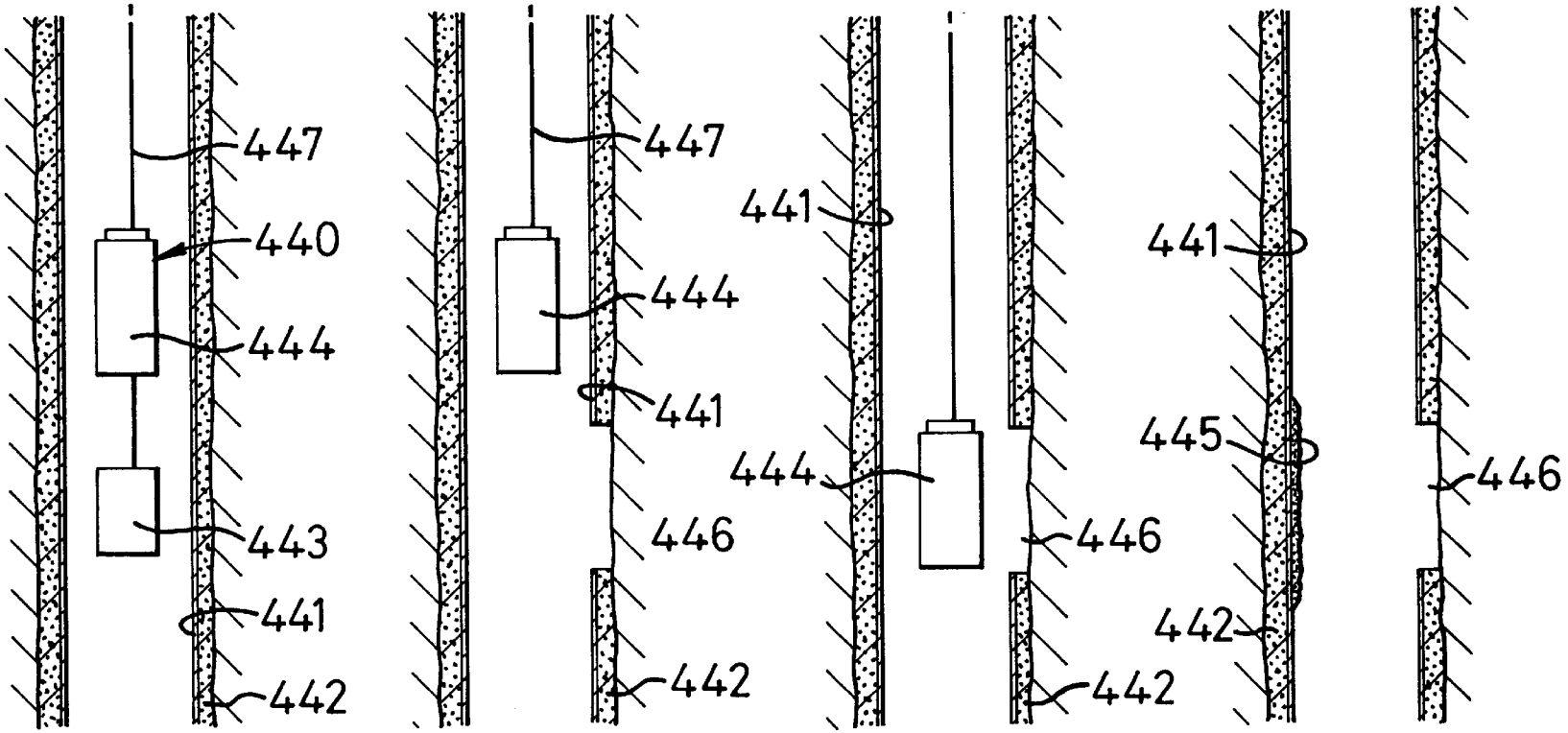
FIG. 21*a* is a schematic side view in cross-section of a system according to the present invention.
FIG. 21*d* shows a hardened area in the wellbore of FIG. 21*a* made by the system of FIG. 21*a*.

FIGS. 20A–20B show a system 430 lowered to a desired location in a casing 431 in a wellbore 432 on a line 437 and oriented as desired. The system 430 includes a main charge 433 fired to form an opening 436 in the casing 431. The system 430 has a secondary charge 434 which is fired to embed a mass of material 435 on the interior wall of the casing 431 adjacent the opening 436. Preferably this material is harder than material of which the casing is made so any cutting tool, mill or bit encountering the mass of material 435 will preferentially mill the casing 431. The material 435 may be one mass or a series of spaced-apart masses may be explosively placed on the casing wall, in one aspect spaced apart so that a mill always is in contact with one of the masses. Also the axial extent of the mass may be varied to coincide with the extent of the opening 436, to extend above it, and/or to extend below it, e.g. to facilitate milling of an entire window in embodiments in which the opening 436 is a partial window, opening, or ledge. As described below, the system 430 can be used to create an anchor member or support member in a tubular.

FIGS. 21A–21D show a system 440 lowered into a casing 441 in a wellbore 442 on a line 447. The system 440 has a main explosive charge 443 for explosively forming an opening 446 in the casing 441 after the system 440 has been oriented as desired in the wellbore 442; and a secondary explosive charge apparatus 444 with a mass of material included therein which is lowered adjacent the opening 446 (FIG. 21C) and fired to produce a layer of material 445 on the casing interior adjacent the opening 446. The layer of material 445 is preferably harder than material of which the casing 441 is made so a cutting tool, mill, or bit will preferentially act on the casing rather than the layer of material 445. The system 440 may be used to create an anchor member or support member in a tubular with a mass of material of sufficient size.

Regarding the systems of FIGS. 18A–22B, any suitable known orienting apparatus, anchor and/or anchor apparatus maybe used as part of the system to anchor the explosives (main charge and/or secondary charge) in place in a casing and so that desired orientation is achieved and maintained.

Figure 22A:
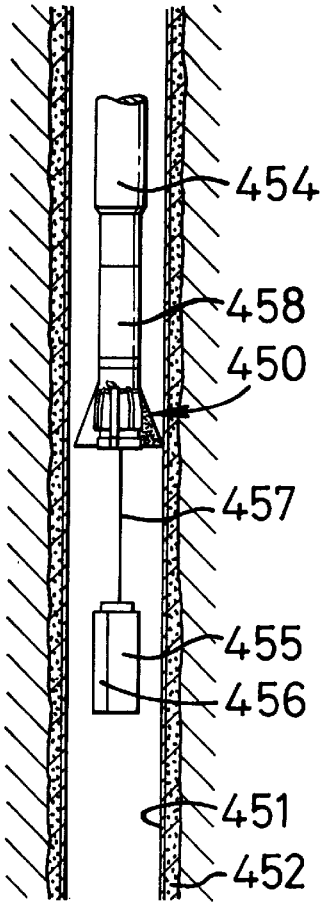
FIG. 22*a* is a schematic side view partially in cross-section of system according to the present invention.
Figure 22B:
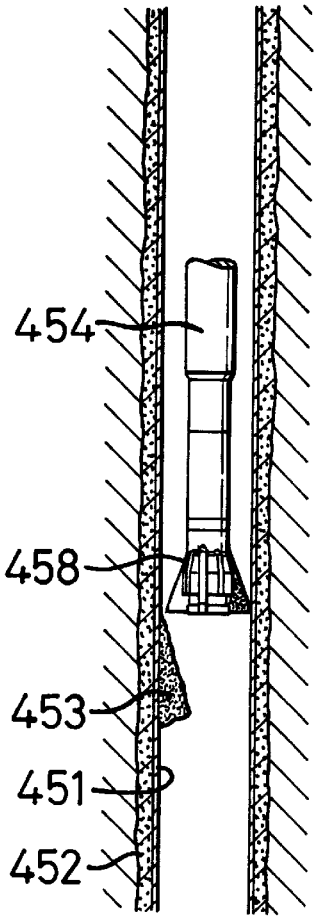
FIG. 22*b* shows a diverter made in the wellbore of FIG. 22*a* with the system of FIG. 22*a*.

FIGS. 22A and 22B shown a system 450 according to the present invention which has a main charge 455 suspended by a member or line 457 from a cutting tool 455 (cutter, reamer, bit, mill(s), or combination thereof) which is connected to a tubular string 454 which extends to the surface in casing 451 in wellbore 452. Alternatively a rope, line, wireline, slickline, or coil tubing may be used instead of the tubular string 454 (as is true for any line or tubular string for any explosive device disclosed herein). The system 450 is lowered in the wellbore 452 so that the main charge 455 is at a desired location and in a desired orientation. Firing the main charge 455 forces a mass of material 456 into or onto the interior wall of the casing 451 to form the diverter 453 (FIG. 22B). The cutting tool 455 is moved down to encounter the diverter 453 which forces the cutting tool against the casing 401. The cutting tool is rotated (e.g. by a downhole motor in the string 454 or by a rotary table) to form a desired opening in the casing 451. Known anchors and orienting devices may be used with this system.

Figure 23:
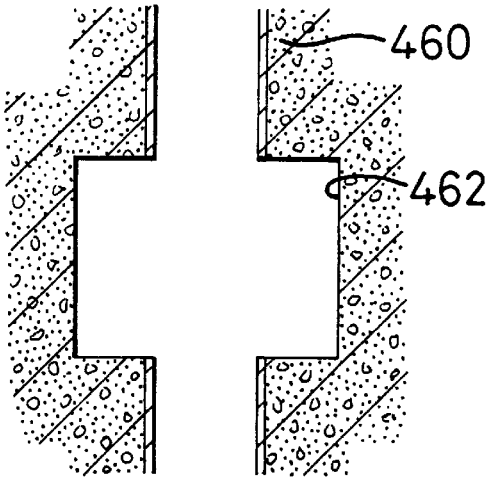
FIG. 23 is a schematic side view in cross-section of a wellbore underreamed with a system according to the present invention.

FIG. 23 shows schematically a wellbore 460 with an enlarged portion 462 formed by firing an explosive charge in the wellbore.

Figure 24:
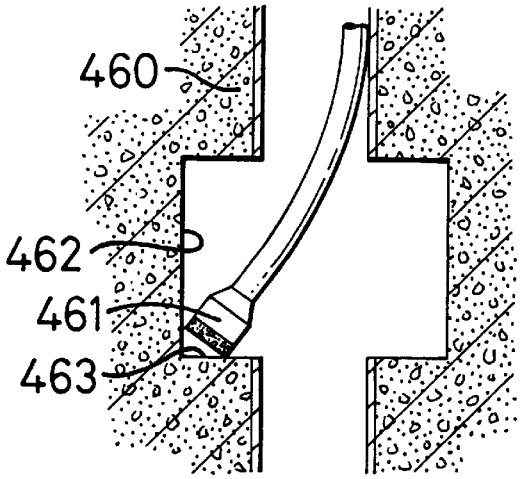
FIG. 24 shows a drilling system that has encountered a lower ledge of the underreamed portion of the wellbore of FIG. 23 and is commencing to drill a lateral wellbore for sidetracking operations.

FIG. 24 shows schematically a drilling system with a drill bit 461 which has encountered a ledge 463 formed by the explosive underreaming of the wellbore 460 and which is directed thereby away from the wellbore 460.

Figure 25:
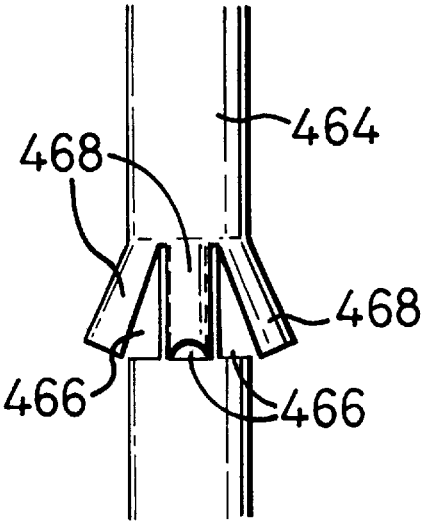
FIG. 25 is a side view of casing with openings formed by a method according to the present invention.

FIG. 25 shows a tubular 464, e.g. a piece of casing downhole in a wellbore, in which an explosive charge or charges have been fired to blow out multiple openings 466 in the casing without completely severing pieces of the casing 468. Since these casing pieces are not completely severed, they provide support for the formation preventing formation cave-in. Also, since each opening is at substantially the same level, multiple same-plane sidetracking is possible using the openings. Any desired number of openings (e.g., two, three, four) may be made at the same level in the casing.

Figure 26:
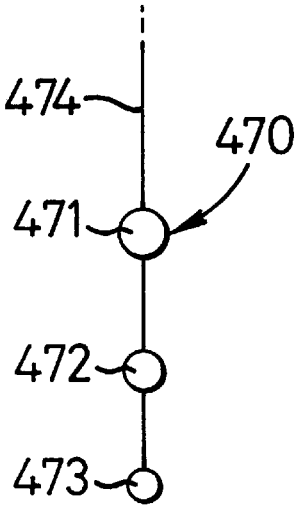
FIG. 26 is a schematic side view of a system according to the present invention.

FIG. 26 shows schematically a system 470 with a plurality of explosive charges 471, 472, 473 on a line 474. The system 470 may have two, four, five or more explosive charges. The system 470 is inserted into a wellbore for underreaming as in FIG. 22; for forming an opening, ledge, window, lateral bores, or hole in casing and/or in a formation (and for use with any system or method described herein using one or more explosive charges; for forming multiple openings (same plane or axially space apart), ledges, windows, lateral bores or holes in casing and/or in formation; for forming a single opening etc. by progressively firing a first charge, forming an initial opening, lowering a second charge adjacent the initial opening and firing it, to enlarge the opening, and so forth with a third or additional charges. The charges may be fired simultaneously or sequentially to form multiple openings, etc. The multiple openings can be oriented in different directions or on different sides of the casing, tubular, or wellbore.

Figure 27:
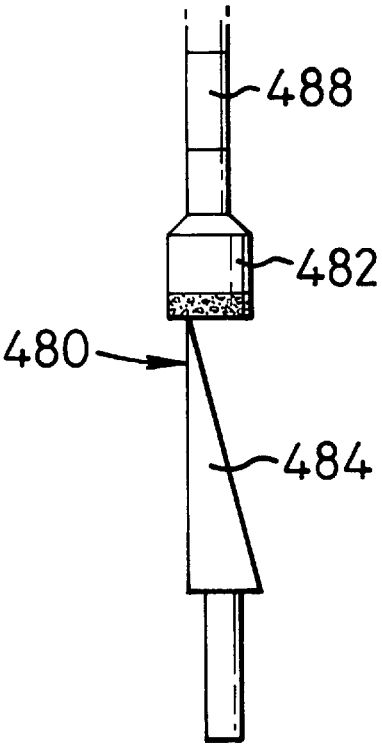
FIG. 27 is a schematic side view of a system according to the present invention.
Figure 28:
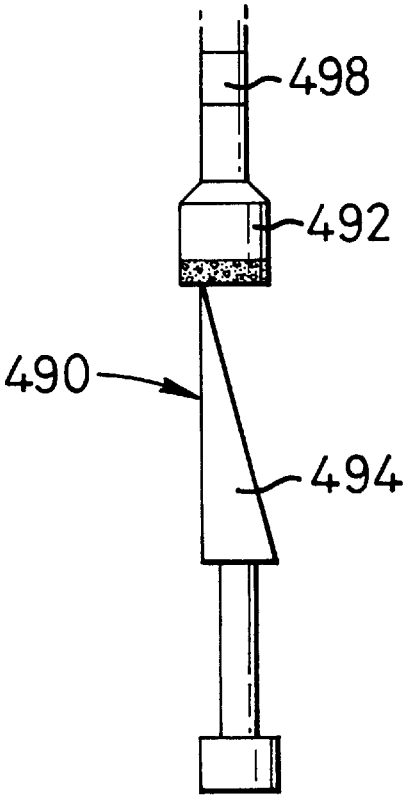
FIG. 28 is a schematic side view of a system according to the present invention.

FIG. 27 shows a system 480 according to the present invention with a mill (or reamer, bit or cutter) 482 releasably attached to a whipstock 484 beneath which and to which is secured an explosive charge (or charges) 486 either secured directly to the whipstock or on a line, rope, cable, etc. beneath and spaced apart from the whipstock. The mill 482 is secured to a tubular string (not shown) extending down into a cased wellbore (not shown). A firing head 488 is associated with the mill 482 and interconnected with the charge 486 (see e.g. the firing head and interconnection in FIG. 8). The charge 486 is fired creating an opening (defined herein for all embodiments as a ledge, hole, lateral bore, or window) in the wellbore casing. The mill 482 and whipstock 484 are then lowered to the location of the opening and the mill 482 may be activated to further mill out a window at that location.

A system 490 as in FIG. 27 is like the system 480 but an anchor 499 is used below a charge 496. The anchor 499 is set at a desired location in the wellbore; the charge is fired creating an opening; the whipstock 494 is lowered to mate with the anchor 499 so it is maintained in place adjacent the opening; the mill 492 is released from the whipstock 494 and mills a window (or part thereof) at the opening. A firing head 498 is similar to the firing head 488 of FIG. 26. Alternatively, the charge can be placed between the mill 492 and the whipstock 494 and the anchor is set after an opening has been explosively made.

In any system described herein in which a whipstock or other member is to be anchored in a casing, tubular, or wellbore, or in which such an item is to be maintained in position therein, an explosive charge apparatus may be used to embed a mass of metal in or on an interior tubular or wellbore wall so that the mass serves as a member to support a whipstock or other item. The mass can close off the bore through the tubular partially (with fluid flow possible therethrough or therearound) or completely and it can be of any suitable metal; easily drillable or millable or drillable or millable with difficulty; e.g. zinc, aluminum, copper, steel, tungsten carbide, stainless steel, armor material, or brass. Any system described above for embedding a mass of material in or on a tubular wall, with a mass of sufficient size, can be used to create such an anchor member.

Figure 29A:
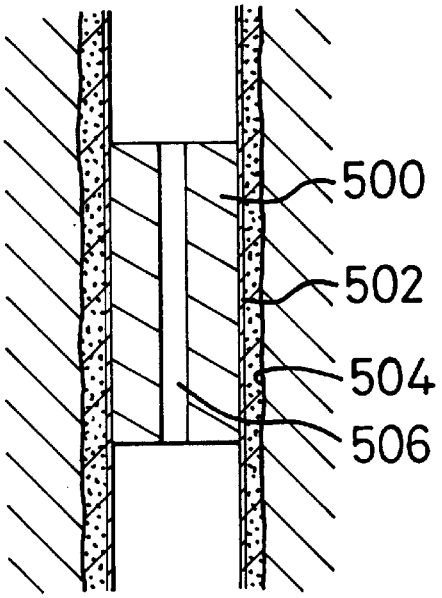
FIG. 29*a* is a side view in cross-section of a wellbore support formed by a system according to the present invention.
Figure 29B:
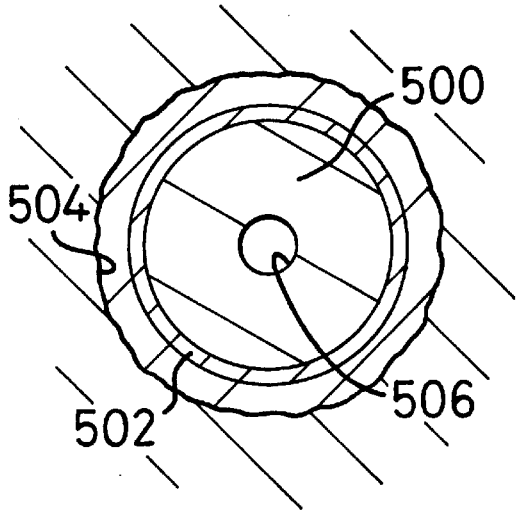
FIG. 29*b* is a cross-section view of the support of FIG. 29*a*.

FIGS. 29*a* and 29*b* show an explosively formed support or anchor mass 500 in a casing 502 in a wellbore 504. The anchor mass has been formed so there is a fluid flow channel 506 therethrough. The anchor mass 500 is suitable for supporting an item above it in the wellbore, e.g., but not limited to, a whipstock. Although the anchor mass is shown as encircling the entire circumference of the casing, it is within the scope of this invention for it to cover only a portion of the circumference.

Figure 30A:
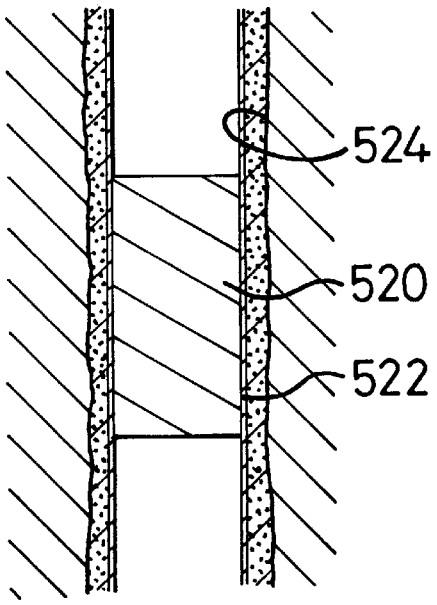
FIG. 30*a* is a side view in cross-section of a wellbore support formed by a system according to the present invention.
Figure 30B:
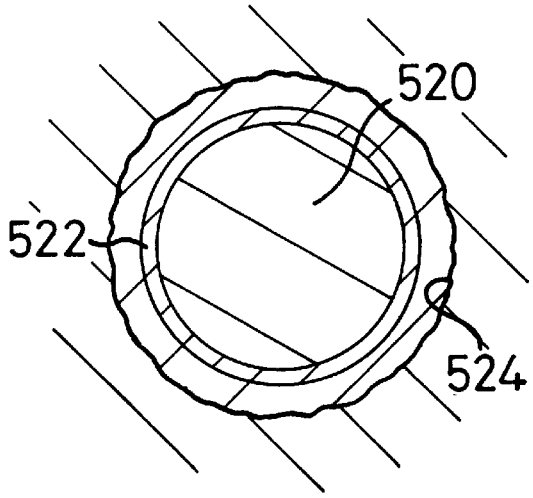
FIG. 30*b* is a cross-section view of the support of FIG. 30*a*.

FIGS. 30*a* and 30*b* show an explosively formed support or anchor mass 520 which completely shuts off fluid flow through a casing 522 in a wellbore 524. The anchor masses of FIGS. 29*a* and 30*a* are formed by exploding an explosive device or devices with a sufficient amount of metal to form the desired mass. The explosion explosively welds the masses to the casing's interior wall and/or embeds part of the metal in the casing.

Figure 31:
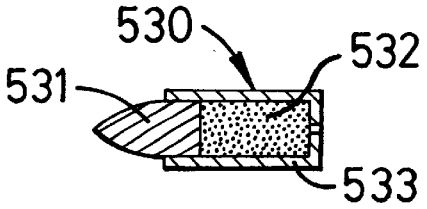
FIG. 31 Prior Art
FIG. 31 is a cross-sectional view of a prior art cartridge.
Figure 32:
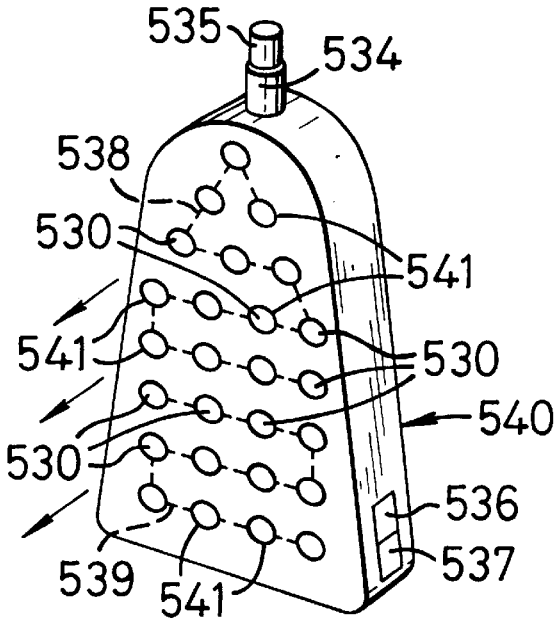
FIG. 32 is a perspective view of a cartridge plate according to the present invention.

FIG. 31 shows schematically a typical prior art bullet or cartridge 530 with a projectile 531 propellant 532, and a case 533. FIG. 32 shows a cartridge plate 540 according to the present invention with a plurality of holes 541 and a cartridge 530 in each hole 541. The plate 540 is shaped and configured, and the holes 541 are disposed and positioned, so that firing the cartridges 530 into a tubular in a wellbore creates a desired hole, ledge, or opening (for subsequent milling) or window (initial or completed). Any number, type, and caliber of appropriate cartridges may be used in any desired array or pattern. In one aspect sufficient cartridges are used that a completed window is created and little or no subsequent milling is necessary. Any suitable plate, member, body, cylinder, or item—flat, curved, hollow, or solid—may be used as a carrier for the cartridges. In one aspect the cartridges 530 at the top of the plate 540 are fired by a primer 534 fired by a firing pin device 535 (both shown schematically). A propellant material 538 interconnects the top fourteen cartridges and the detonation of the first cartridge 530 therefore results in the almost simlutaneous detonation of the remaining top thirteen cartridges as the propellant ignites, firing each cartridge. Similarly the bottom twelve cartridges are fired by a primer 536 fired by a firing pin device 537. These lower cartridges are interconnected with propellant 539. Any suitable firing device or mechanism other than the primer/firing-devices shown schematically or described herein may be used, including but not limited to electrical ignition and hot wire devices. The primers 534 and 537 may be activated simultaneously or sequentially with appropriate lines and interconnections extending from the system to the surface or to appropriate timer devices. In one aspect the firing pin devices have control lines running from them to control apparatus at the surface for selective activation thereof. Timer devices may be used at the location of the system in the wellbore, at another location in the wellbore and interconnected with the window forming system, or at the surface with appropriate connections to the system in the wellbore. In one aspect a single primer, single line of propellant, and single firing device is used to fire all cartridges in a plate simultaneously.

Figure 33A:
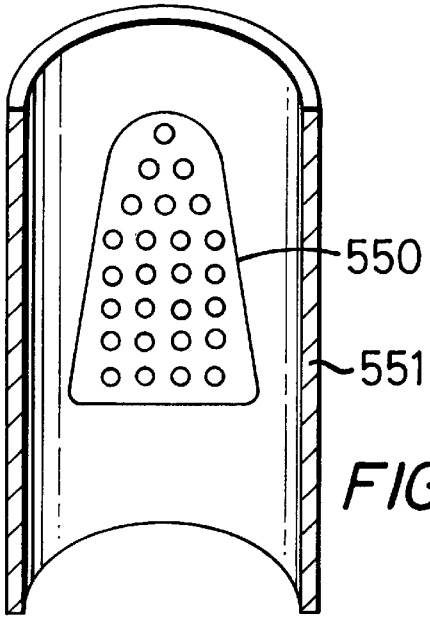
FIG. 33A is a side view of a casing with a window in it created with a system according to the present invention.
Figure 33B:
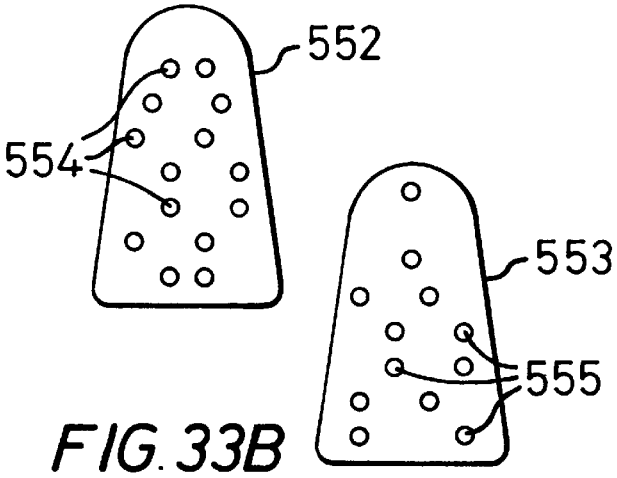
FIG. 33B is an exploded view of a dual cartridge plate system according to the present invention.

FIG. 33A shows a window 550 produced in a casing 551 by the sequential firing of at least two plates with cartridges like the plate 540. "X's" show schematically material removed by firing a first plate and "o's" show schematically material removed by firing a second plate. FIG. 33B shows schematically two firing plates (like the plate 540 described above) used together, e.g. in place in a wellbore abutting and/or adhered to each other, to create a window like the window 550 (FIG. 33A). A first plate 552 has cartridges 554 and a second plate 553 has cartridges 555 which are offset from those of the plate 552.

Figure 34:
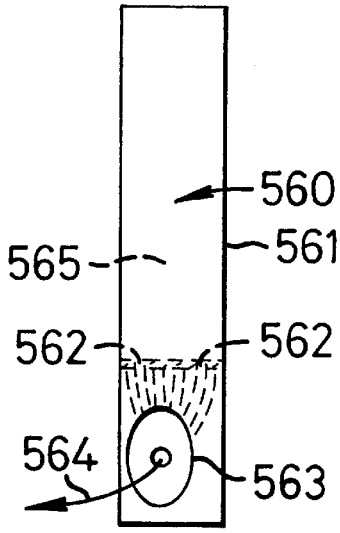
FIG. 34 is a side view of a wellbore window creation system according to the present invention.

FIG. 34 shows an apparatus 560 with a hollow container 561 in which occurs a relatively severe oxidation reaction of materials 565 which produces sufficient heat so that a heat jet 564 exits from within the container 561 to openings or nozzles 562 and then to an outlet (or outlets) 563 from which the heat jet 564 is directed at a tubular member in which an opening is to be formed. The nozzles are optional and are used to increase exiting reaction product flow velocity. The oxidation reaction, in certain embodiments, may be any know thermitic or pyranol reaction; also suitable propellants, e.g. solid rocket propellants, may be used.

Figure 35:
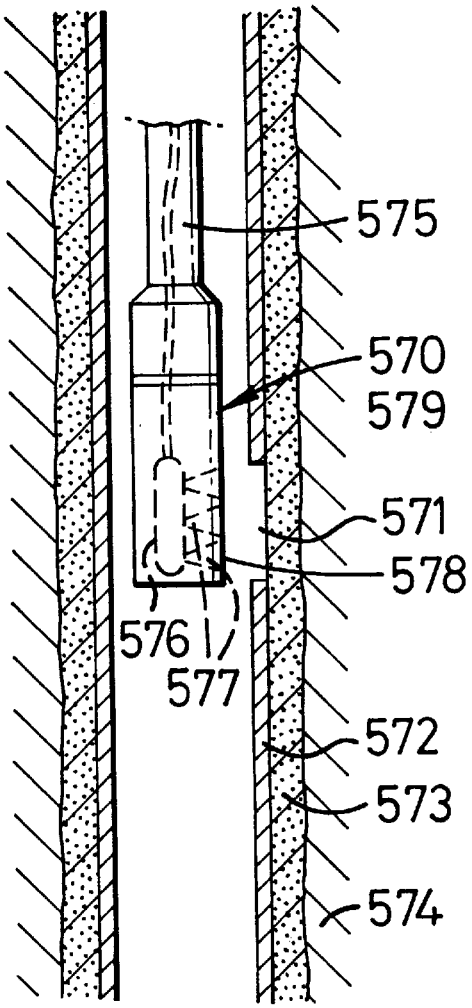
FIG. 35 is a side view in cross-section of a wellbore window creation system according to the present invention.

FIG. 35 shows schematically a system 570 for producing a window 571 is a casing 572 in a wellbore 573 extending from the earth's surface in an earth formation 574. The system 570 is on a tubular string 575 extending through the wellbore to the earth's surface. An oxyacetylene generator 576 shown schematically in FIG. 35 (and which includes an igniter device) produces a flame directed through openings 577 in a tubular body 578. The flame is sufficiently hot to heat the casing to an oxidizing temperature so that part of it burns away to form the window 571 in the casing 572. The generator 576 is selectively activated from the surface via a line (or lines) 579. Activating apparatus interconnected with the generator 576 may be electrical, hydraulic, and/or mechanical. In one aspect separate oxygen and acetylene lines extend from the generator to the earth's surface and suitalbe pumping apparatus pumps the materials down to the generator in the wellbore. In another aspect, accessible containers of the materials are located in or adjacent the generator in the wellbore and are in fluid communication therewith. Any fuel and oxidizer may be used in addition to or in combination with oxygen and acetylene.

Figure 36:
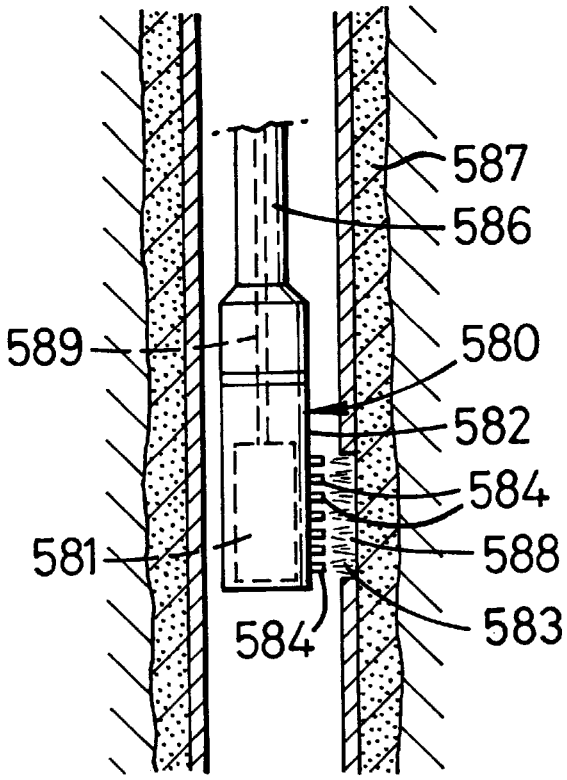
FIG. 36 is a side view in cross-section of a wellbore window creation system according to the present invention.

FIG. 36 shows schematically a system 580 on a tubular string 586 extending to the earth's surface through a wellbore 587 with a water jet generator 581 in a body 582. Water jets 583 exit nozles 584 with sufficient force to cut a window 588 in a wellbore casing 585 of the tubular string 586. The body 582 may be reciprocated up and down so cut out of the window 588 is complete. The generator 581 is selectively activated from the surface via a line or lines 589 (electrically, hydraulically, and/or mechanically).

Figure 37:
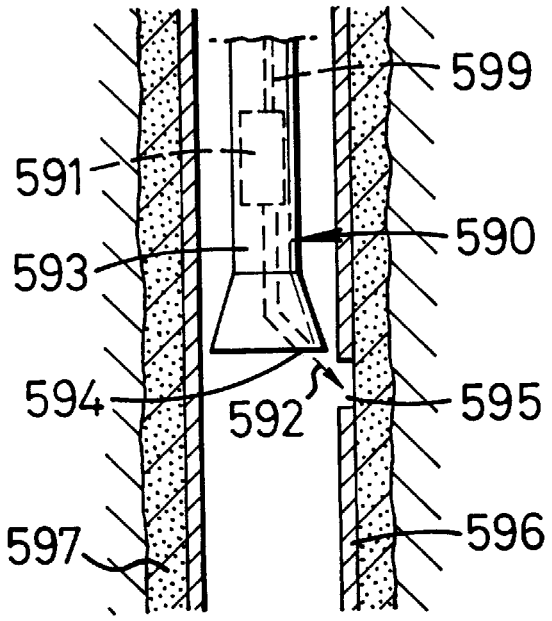
FIG. 37 is a side view in cross-section of a wellbore window creation system according to the present invention.

FIG. 37 shows schematically a mill 590 with a hollow interior containing an abrasive and/or erosive stream generator 591 which produces a stream 592 which exits a body 593 of the mill 590 through an exit port 594 (one or more may be used) to cut an opening 595 in a casing 596 in an earth wellbore 597. The generator 591 is selectively activated from the surface via a line (or lines) 599. The opening 595 may be a small initial cut or ledge as shown; or an opening of any desired size, shape, or elongation may be formed by the stream 592.

Figure 38:
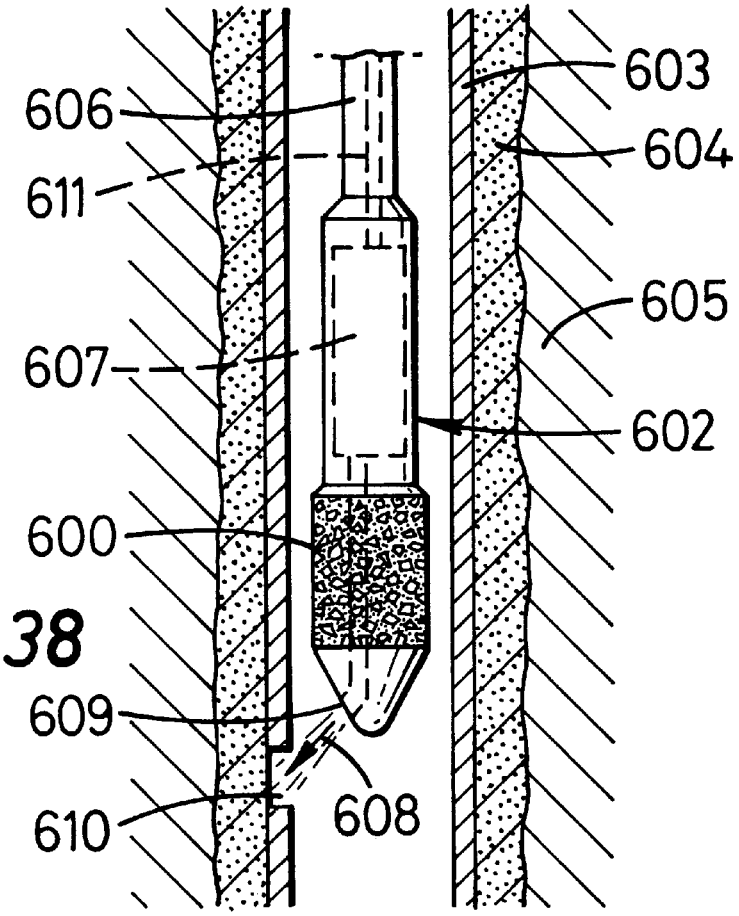
FIG. 38 is a side view in cross-section of a wellbore window creation system according to the present invention.

FIG. 38 shows a mill 600 with an upper body 602 in a casing 603 in a wellbore 604 in a formation 605. The mill 600 is connected to a tubular string 606 that extends to the earth's surface. A water jet generator 607 in the body 602 (or optionally in the mill 600) produces a cutting water jet 608 which exits the mill 600 through a port 609 to cut an opening 610 in the casing 603. The generator 607 is selectively activated via a line 611 that extends to the surface. Alternatively, the water jet may be generated in a device located further up in the tubular string above the mill or in a device at the surface. The mill 600, in one aspect, is like the mill 150 disclosed in pending U.S. application Ser. No. 08/532,180.

A whipstock, diverter, or weight member may be used with the mills 590 and 600 to direct them to an opening made according to this invention.

It is within the scope of this invention for any of the devices and systems of FIGS. 31–38 ("the devices") to be used to create an initial opening, initial ledge, initial window, or completed window ("the openings") through a tubular. It is within the scope of this invention for any of the devices to be used on, releasably connected to, or secured beneath a mill or mills to create one of the openings. It is within the scope of this invention for any of the devices to be used on, used with, releasably connected to, or secured to or above, a whipstock, diverter, or weight member. Any of the systems of FIGS. 35–38 may be reciprocated up and down and/or rotated or swiveled from side to side to form an opening of a desired longitudianl extent, desired lateral extent, and desired shape.

Figure 39:
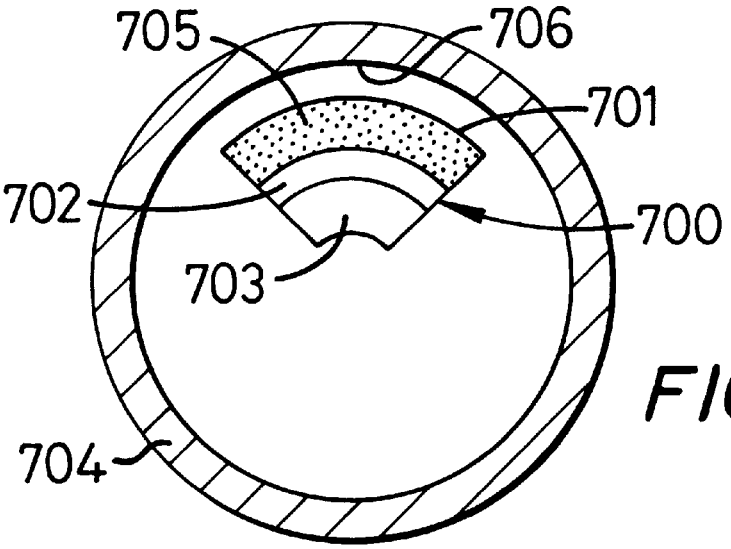
FIG. 39 is a top schematic view of a window formation system according to the present invention.

FIG. 39 shows schematically a wellbore window formation system 700 according to the present invention which has an explosive charge 703 backing a metal flyer or metal plate (solid or patterened for fragmentation) 702. The plate 702 is secured to a container 701 which contains material 705. Firing the explosive charge 703 forces the plate 702 against the container 701 breaking it and propelling the material 705 against an interior area 706 of a wellbore tubular 704, e.g. but not limited to tubing or casing. The tubular area behind the charge 703 is not adversely affected by the material 705 since the plate 702 is forced in an opposite direction. The material 705 either weakens the tubular wall at the area 706, etches the wall in a desired shape, or cuts through it—depending on the amount and type of explosive charge, plate, and material propelled. The material may be, but is not limited to, water, oil, drilling fluid, hydraulic fluid, liquid with abrasive and/or erosive material therein, a mass of granular and/or particulate material (congealed, glued, adhered together, or contained in a ruptureable or breakable container), or any combination thereof. The container 701 is made of an appropriate flexible, rigid, or solid material, e.g. but not limited to plastic, foil, wood, paper, or nonsparking materials.

Filed on Jul. 30, 1996 and co-owned with this application is the U.S. application attached to the parent hereof, U.S. application Ser. No. 08/688,651 as an Appendix, (which is made a part hereof for all purposes) entitled "Wellbore Single-Trip Milling."

Figure 40A:
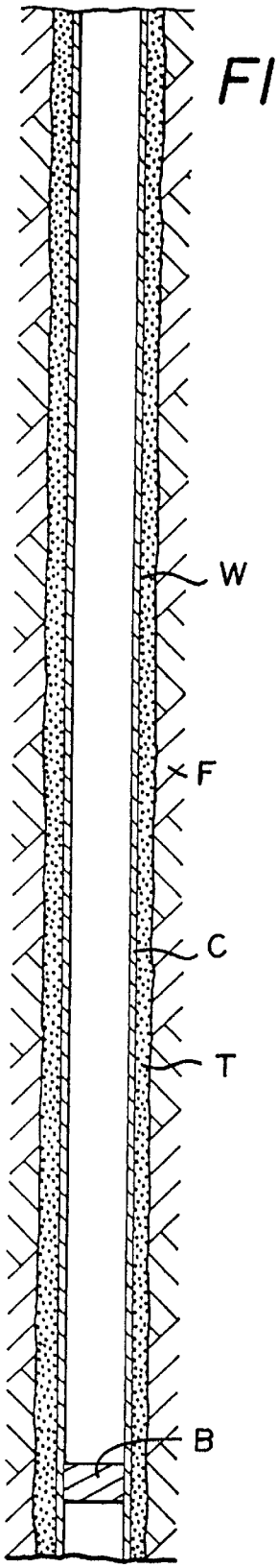
FIG. 40A–40F are side views of a method according to the present invention.

FIGS. 40A–40F illustrate a method and certain apparatuses according to the present invention. FIG. 40A shows a wellbore W through a formation F cased with casing C cemented in place by cement T with a bridge plug B set in the casing C.

Figure 40B:
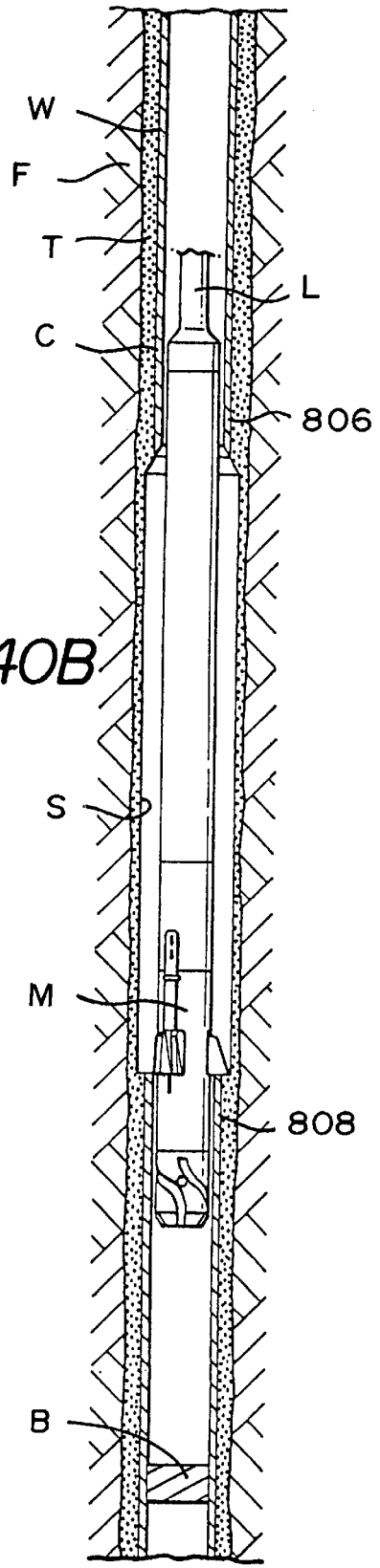

FIG. 40B shows a typical section mill M on a drill string L (shown partially, but extends up to surface equipment) which has milled out a section S from the casing C. This milling has also resulted in the milling of some of the cement T adjacent the section S. A top stub 806 and a bottom stub 808 of the casing remain.

Figure 40C:
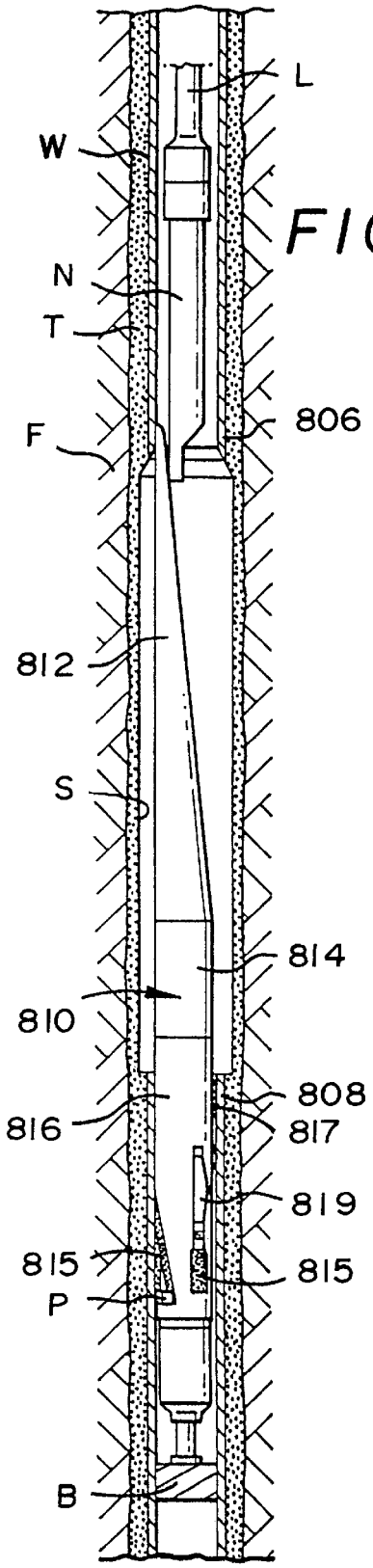

FIG. 40C shows a whipstock 810 according to the present invention with a concave 812 releasably secured to a body extension 814 which is itself releasably secured to a lower body member 816. A setting tool N is releasably secured (e.g. by a shear pin, not shown) to the concave 812. Alternatively a starting mill releasably secured to the concave by a shear pin or shear bolt may be used instead of the setting tool. Anchor apparatus P anchors the whipstock 810 in place on the bridge plug B and in the casing C. In other aspects instead of a bridge plug a packer or other "false bottom" device is used, or the whipstock is set on the bottom of the wellbore. Any suitable anchor apparatus (including well-known apparatuses not shown) may be used. The anchor apparatus P includes slips 815 and a pivot slip 817 which provides a fulcrum point about which the whipstock pivots. As shown in FIG. 40C the anchor apparatus is disposed on a part of the lower body 816 in the casing C beneath the section S. It is within the scope of this invention to anchor the whipstock 810 (or other deflection device used instead of the whipstock 810) within the section S; and, in certain embodiments, to anchor it on the top of the bottom stub and to use the bottom stub as a "trigger" to actuate setting or anchoring devices. Alternatively, anchoring both within the section S and within the casing C is within the scope of this invention. Stabilizers 819 (one shown) protect the slips while the whipstock is run into the wellbore.

The whipstock 810 is sized and disposed so that a top end of the concave 812 abuts the top stub 806 of the casing C. The lower body 816 abuts the bottom stub 808. It is within the scope of this invention for the concave to be of sufficient length to abut both stubs. In the embodiment shown in FIG. 40C the body extension 814 is of sufficient length that the concave 812 does not contact the bottom stub 808. Also, with the body extension of such a length a mill or drill bit is deflected sufficiently that it preferably will not contact the bottom, stub 808 or parts of the whipstock within the bottom stub 808 (or will contact them only incidentally). As shown the whipstock 810 bridges the sections S from the top stub 806 to the bottom stub 808. In certain embodiments the section S is four to five feet long (up to fifty feet) and the whipstock is long enough to bridge the milled out section.

Figure 40D:
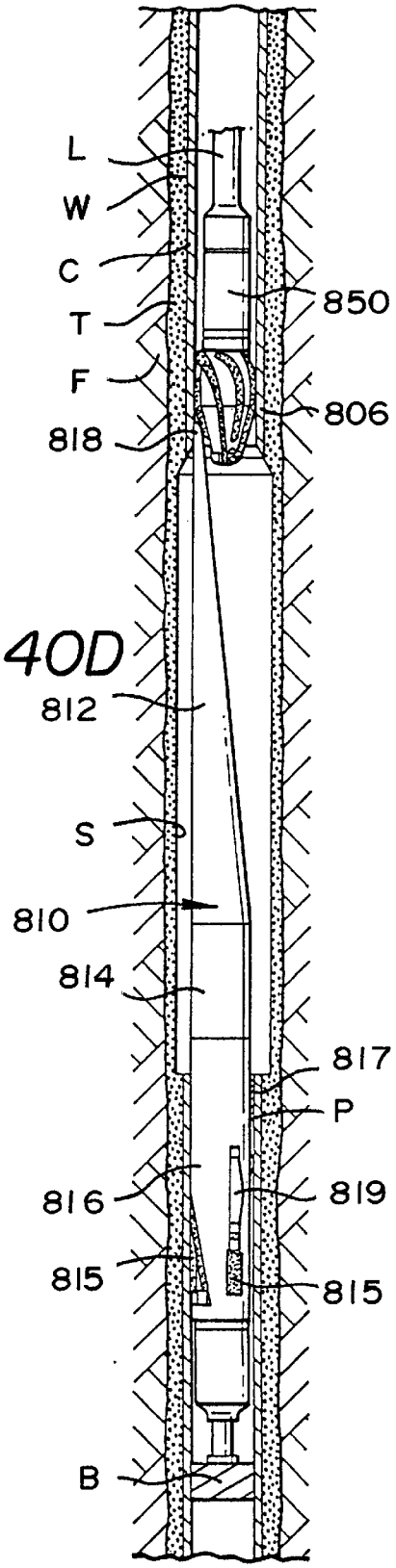

FIG. 40D shows the setting tool N removed and a mill 850 according to the present invention on a drill string L (or a coil tubing drilling system may be used) which has been inserted into the casing C and has contacted a top 818 of the concave 812 at which point milling of the top stub 806 has commenced.

Figure 40E:
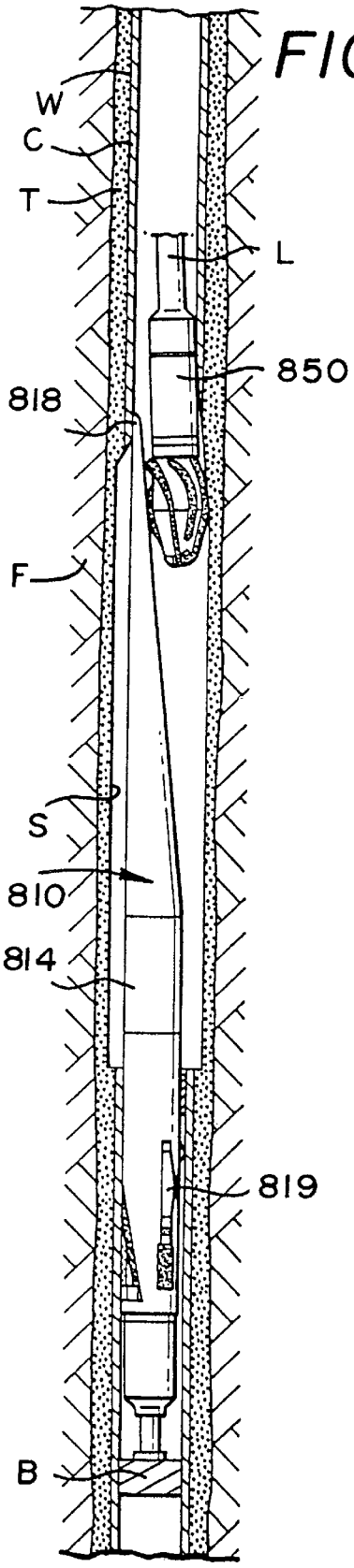

FIG. 40E shows the mill 850 as it has milled down past the end of the top stub 806 to contact the cement T (and, possibly, mill some of the cement T).

Figure 40F:
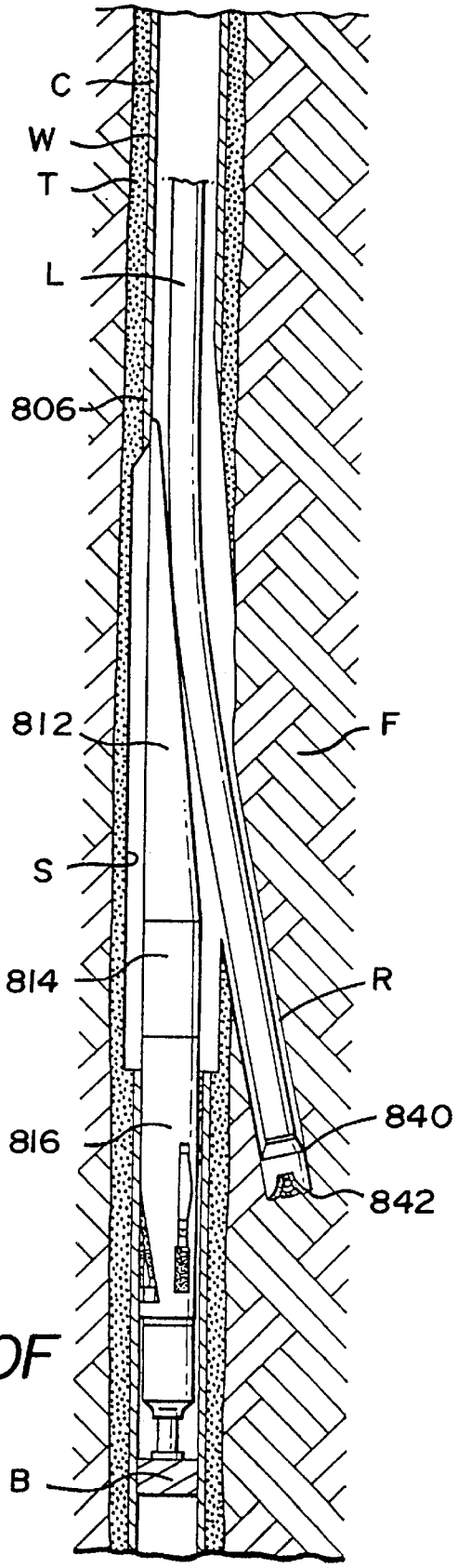

FIG. 40F shows that the mill 850 has been removed and a drill system 840 on the drill string L has been introduced into the casing C, has been deflected toward the section S by the concave 812, and has drilled a new bore R into the formation F. A drill bit 842 of the drill system 840 did not contact the top stub 806 in the drilling of the bore R. Also, the bit 842 has been deflected in such a way that it has not contacted the bottom stub 808 or the lower portion of the whipstock 810.

Figure 41A:
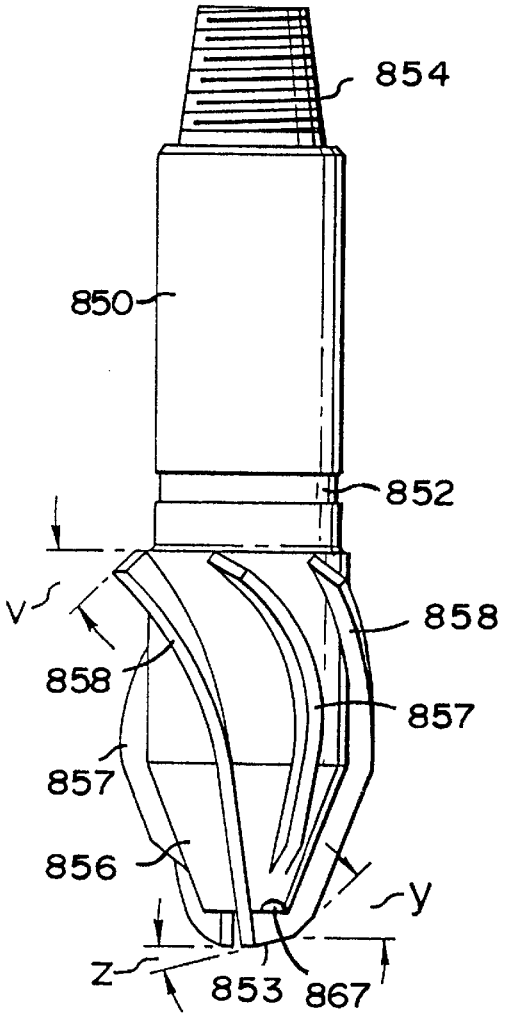
FIG. 41A is a side view of a mill according to the present invention.
Figure 41B:
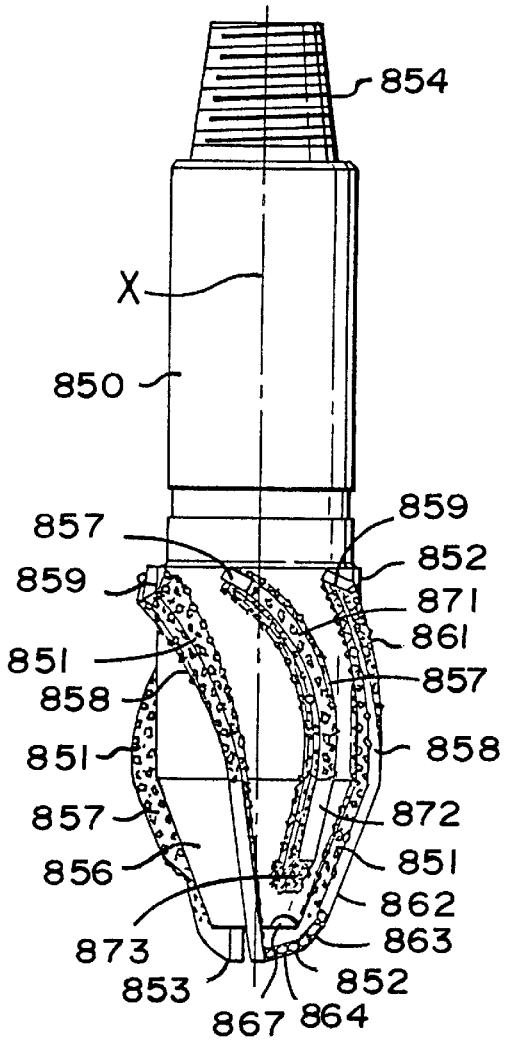
FIG. 41B is a side view and FIG. 41C is a bottom view of the mill of FIG. 41A.
Figure 41C:
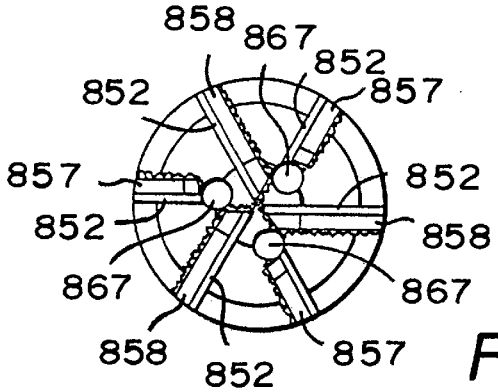

FIGS. 41A–41C show various views of the mill 850. The mill 850 has a body 852 with a bottom nose 853, a top threaded end 854 and a bottom mill end 856. The mill end 856 has six blades, three blades 857 and three blades 858 extending outwardly and downwardly therefrom. As shown in FIGS. 41B and 41C, each blade may be dressed with tungsten carbide material 851 and/or milling inserts 852. It is within the scope of this invention for the blades to be dressed with materials and inserts according to any of the ways and patterns well-known in the art. It is also within the scope of this invention to use the inserts and other teachings of the U.S. application entitled "Wellbore Milling Tools & Inserts" naming Christopher P. Hutchinson as inventor, U.S. Ser. No. 08/532,474 filed on Sep. 22, 1995 and co-owned with this application. It is within the scope of this invention to use any known section mill for the step shown in FIG. 40D. It is also within the scope of this invention to use the mill disclosed in the U.S. application entitled "Section Milling" naming Christopher P. Hutchinson as inventor, U.S. Ser. No. 08/532,473 filed on Sep. 22, 1995 and co-owned with this application. Both applications cited above are incorporated fully herein for all purposes.

Each blade 858 extends from a blade top 859 to the bottom nose 853 of the mill 850. Each blade 858 has four milling surfaces 861, 862, 863, and 864. These milling surfaces are sized, configured, and disposed so that the mill 850 avoids or minimizes contact with the formation F, yet adequately mills away the bottom stub 806. The milling surface 862 is at an angle of about 23° to a central longitudinal axis X of the mill 850. The milling surface 863 is at an angle y to the horizontal. The angle y for the mill 850 as shown is about 45°. The milling surface 864 is at an angle of about 15° to the horizontal. The tops 859 of the blades 858 are at an angle of about 45° to the horizontal.

Each blade 857 has three milling surfaces 871, 872, and 873. The milling surfaces 871 on the blades 857 correspond to the milling surfaces 861 on the blades 858. The milling surfaces 872 correspond to the milling surfaces 862 on the blades 858. The milling surfaces 872 are also angled as are the milling surfaces 862 so that milling of the formation F is avoided (or reduced), (as are the milling surfaces 863 and 873). The mill end 856 is tapered to accommodate the various angled milling surfaces of the blades.

A plurality of fluid flow bores extend down through the mill 850 for the flow of circulating fluid through the mill to facilitate the evacuation of milled material. Fluid exits from these bores through exit ports 867 in the bottom nose 853 and then flows back up past the blades. It is within the scope of this invention to provide a mill without blades, but with angled milling surfaces which effect avoidance of formation contact or reduced formation contact.

FIG. 42 shows a whipstock 880 with an upper concave member 882; a body extension 884 connected to the upper concave member 882; and a lower whipstock portion 886 connected to the body extension 884. These connections may be permanent, e.g. welded, or releasable, e.g. shear-pinned or threaded. It is within the scope of this invention to use a retrievable whipstock as disclosed in U.S. Pat. No. 5,341,873 (co-owned with the present application).

FIG. 43A illustrates a retrievable whipstock 900 in a wellbore 902 in which is cemented casing 904 with cement 906. A formation 907 surrounds the wellbore 902. The whipstock rests on a bridge plug 903. The whipstock has a concave 910 which has a top 912 that rests against a top stub 914 of the casing 904. A lower portion of the whipstock body 916 rests against a bottom casing part 918. Slips 922 and 924 secure the whipstock 900 in the lower casing. It is desirable to mill off the part of the top stub 914 indicated by the bracket and numeral 930 to facilitate entry of a bit into the formation.

As shown in FIG. 43B the part 930 has been milled out by a mill 950 according to the present invention and the mill 950 has not milled past the cement 906. The mill 950 has an angled mill surface 952 which is substantially parallel to a formation surface 926 and a nose 954 of the mill 950 is blunt so that it does not contact the formation when the mill is in the position shown in FIG. 43B. By employing a mill with a blunt nose and inwardly tapered sides and/or inwardly tapered blades (see FIGS. 41A and 43B) (tapered inward from top to bottom), contact with the formation is reduced or avoided completely (see FIGS. 40E and 43B). Preferred methods according to this invention are useful in producing sidetracked bores at relatively abrupt angles to the axis of a main wellbore, e.g. an angle of at most about thirty degrees and as small as about one degree. By using such a taper mill milling is effected to an extent equal to the total width of the mill and no undesirable unmilled casing portion or sliver is produced.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are entitled to the filing date of the first parent case, Dec. 11, 1995, and are intended to cover the invention as broadly as legally possible in whatever form it may be utilized. The invention claimed herein is new and novel in accordance with 35 30 U.S.C. §102 and satisfies the conditions for patentability in §102. The invention claimed herein is not obvious in accordance with 35 U.S.C. §103 and satisfies the conditions for patentability in §103. This specification and the claims that follow are in accordance with all of the requirements of 35 U.S.C. §112.

What is claimed is:

1. A method for making a window in a selected wellbore casing member for a wellbore sidetracking operation therethrough, the wellbore extending from an earth surface down into the earth, the method comprising installing through the wellbore a system for making the window, the system including explosive means interconnected to a location device, the explosive means for explosively forming the window in the selected wellbore casing member, the explosive means including at least one explosive charge sized and configured to create the window and to create a minimum of debris in the wellbore, and detonating the at least one explosive charge to explosively form the window.

2. The method of claim 1 wherein the at least one explosive charge is self consuming.

3. The method of claim 1 wherein the system includes shock attenuation material on sides of the at least one explosive charge and the method further comprising attenuating with the shock attenuation material effects of the detonation of the at least one explosive charge.

4. The method of claim 1 wherein the method is a single trip method for forming the window in a single trip into the wellbore.

5. The method of claim 4 wherein the system includes a milling apparatus interconnected with a diverter device interconnected with the at least one explosive charge for diverting milling apparatus to the window formed in the selected tubular, the method further comprising diverting the milling apparatus against the selected wellbore casing member with the diverter device.

6. The method of claim 1 wherein the system includes a milling apparatus interconnected with a diverter device interconnected with the at least one explosive charge for diverting milling apparatus to the window formed in the selected tubular, the method further comprising diverting the milling apparatus against the selected wellbore casing member with the diverter device.

7. The method of claim 1 wherein the system includes milling apparatus interconnected with the at least one explosive charge, the method further comprising after formation of the window, milling at the window with the milling apparatus.

8. An apparatus for making a window in a selected wellbore casing member for a wellbore sidetracking operation therethrough, the wellbore extending from an earth surface down into the earth, the apparatus comprising a location device for locating the apparatus in the wellbore, and explosive means interconnected with the location device, the explosive means including at least one explosive charge for making the window in the selected wellbore casing member, and the at least one explosive change sized and configured to create the window and to create a minimum of debris in the wellbore.

9. The apparatus of claim 8 wherein the at least one explosive charge is self-consuming.

10. The apparatus of claim 8 wherein the system includes shock attenuation material on sides of the at least one explosive charge and the method further comprising attenuating with the shock attenuation material effects of the detonation of the at least one explosive charge.

11. A method for making a radial ledge in a selected casing member in a wellbore, the wellbore extending from an earth surface down into the earth, the radial ledge for facilitating initial penetration thereof by a mill milling at the radial ledge, the method comprising installing through the wellbore an apparatus for making the radial ledge, the apparatus including a location device for locating the apparatus in the wellbore and explosive means interconnected to the location device, the explosive means for explosively forming the radial ledge in the selected wellbore casing member, the explosive means including at least one explosive charge sized and configured for forming the radial ledge and to create a minimum of debris in the wellbore, and detonating the at least one explosive charge to explosively form the radial ledge.

12. An apparatus for making a radial ledge in a selected wellbore casing member in a wellbore, the wellbore extending from an earth surface down into the earth, the radial ledge for facilitating initial penetration thereof by a mill milling at the radial ledge, the apparatus comprising a location device for locating the apparatus in the wellbore, and explosive means interconnected with the location device, the explosive means including at least one explosive charge for making the radial ledge in the selected wellbore casing member, the at least one explosive charge sized and configured for forming the radial ledge and to create a minimum of debris in the wellbore.

13. The method of claim 12 wherein the at least one explosive charge is self consuming.

14. The method of claim 12 wherein the system includes shock attenuation material on sides of the at least one explosive charge and the method further comprising attenuating with the shock attenuation material effects of the detonation of the at least one explosive charge.

15. A method for making an opening to inhibit or prevent coring of a mill milling a selected wellbore casing member in a wellbore, the wellbore extending from an earth surface down into the earth, the method comprising installing through the wellbore an apparatus for making the opening, the apparatus including a location device for locating the apparatus in the wellbore and explosive means interconnected to the location device, the explosive means for explosively forming the opening in the selected wellbore casing member, the explosive means including at least one explosive charge, and the at least one explosive charge sized and configured to create the window and to create a minimum of debris in the wellbore, and detonating the at least one explosive charge to explosively form the opening.

16. The method of claim 15 wherein the at least one explosive charge is self consuming.

17. The method of claim 15 wherein the system includes shock attenuation material on sides of the at least one explosive charge and the method further comprising attenuating with the shock attenuation material effects of the detonation of the at least one explosive charge.

* * * * *